US006672845B1

(12) United States Patent
Kim et al.

(10) Patent No.: US 6,672,845 B1
(45) Date of Patent: Jan. 6, 2004

(54) APPARATUS FOR PREVENTING VACUUM COMPRESSION OF SCROLL COMPRESSOR

(75) Inventors: Phill Whan Kim, Changwon (KR); Young Bae Lee, Changwon (KR); Byung Ha Ahn, Pusan (KR); Sung Jun Lee, Changwon (KR); Hong Gyun Jin, Jinhae (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/980,215

(22) PCT Filed: Feb. 19, 2000

(86) PCT No.: PCT/KR00/00133

§ 371 (c)(1),
(2), (4) Date: Jan. 30, 2002

(87) PCT Pub. No.: WO00/73659

PCT Pub. Date: Dec. 7, 2000

(30) Foreign Application Priority Data

| | | |
|---|---|---|
| Jun. 1, 1999 | (KR) | 1999/20052 |
| Oct. 14, 1999 | (KR) | 1999/44555 |
| Dec. 10, 1999 | (KR) | 1999/56485 |
| Dec. 10, 1999 | (KR) | 1999/56486 |
| Dec. 10, 1999 | (KR) | 1999/56487 |

(51) Int. Cl.[7] ..... F04B 49/00

(52) U.S. Cl. ..... 417/310; 417/311; 417/309; 417/410; 417/410.3

(58) Field of Search ..... 417/310, 311, 417/309, 410.3, 440

(56) References Cited

U.S. PATENT DOCUMENTS

| | | | | |
|---|---|---|---|---|
| 5,090,880 A | * | 2/1992 | Mashimo | 417/310 |
| 5,156,539 A | * | 10/1992 | Anderson et al. | 418/55.4 |
| RE35,216 E | * | 4/1996 | Anderson et al. | 417/310 |
| 5,591,014 A | * | 1/1997 | Wallis et al. | 417/310 |
| 6,457,948 B1 | * | 10/2002 | Pham | 417/292 |
| 6,494,688 B1 | * | 12/2002 | Barito et al. | 417/310 |
| 6,592,344 B2 | * | 7/2003 | Witham et al. | 418/55.1 |
| 2002/0102165 A1 | * | 8/2002 | Kim | 417/310 |
| 2003/0035736 A1 | * | 2/2003 | Nam | 417/292 |

FOREIGN PATENT DOCUMENTS

| | | |
|---|---|---|
| JP | 59-192880 A | 11/1984 |
| JP | 62-23589 A | 1/1987 |
| JP | 3-124982 A | 5/1991 |
| JP | 03-267591 A | 11/1991 |

* cited by examiner

*Primary Examiner*—Justine R. Yu
*Assistant Examiner*—William H. Rodriguez
(74) *Attorney, Agent, or Firm*—Birch, Stewart, Kolasch & Birch, LLP

(57) ABSTRACT

An apparatus for preventing vacuum compression of a scroll compressor comprising: a suction tube and a discharge tube each combined to one side of a closed container filled with oil to an adequate height; a fixing scroll having a wrap and a coolant inlet and an outlet; a high and low pressure separating plate installed at the upper side of the fixing scroll, dividing the inside of the closed container into a high pressure chamber and a low pressure chamber, the high and low pressure separating plate having a gas discharge hole at its central portion; an orbiting scroll having a plurality of compressive chambers for compressing a sucked coolant by being rotably engaged with the wrap of the fixing scroll at the lower side of the fixing scroll, and having a wrap for rendering each compressive chamber to have different pressure to be successively moved as being turned; and a high vacuum preventing unit installed at the inner side of the body of the fixing scroll.

29 Claims, 22 Drawing Sheets

APPARATUS FOR PREVENTING VACUUM COMPRESSION OF SCROLL COMPRESSOR

This application is the national phase under 35U.S.C. §371 of PCT International Application No. PCT/KR00/00133 which has an International filing date of Feb. 19, 2000, which designated the United States of America and was published in English.

TECHNICAL FIELD

The present invention relates to an apparatus for preventing vacuum compression of a scroll compressor, and in particular, to an apparatus for preventing vacuum compression of a scroll compressor by which even if a compressor is continuously operated in a state that coolant does not flow into an inlet of a suction tube as the suction tube is clogged the coolant is partially leaked to a low pressure chamber, so that the inside of the compressor is not reduced to an ultra-vacuum state.

BACKGROUND ART

Generally, compressors in use for air conditions or refrigerators serve to convert mechanical energy to compression energy of a compressible fluid. Compressors mainly include a reciprocating type compressor, a scroll type compressor, a centrifugal type compressor (normally called a turbo type compressor), and a vane type compressor (normally called rotary type compressor).

Among them, the scroll compressor sucks and compresses gas by using a rotor to discharge it, which is like the centrifugal compressor or the vane compressor. In contrast, the reciprocating compressor uses a linear movement of a piston for the same purpose.

The scroll compressor includes a low pressure scroll compressor or a high pressure scroll compressor depending on whether a suction gas is filled inside a closed container or a discharge gas is filled therein.

FIG. 1 shows a general low pressure scroll compressor in use for the air conditioners or the refrigerators.

As shown in the drawing, the upper and the lower frames 4 and 4' are fixedly installed at the upper and lower portion of the inside a closed container 3. A suction tube 1 for sucking a coolant gas and a discharge tube 2 for discharging the high pressure coolant gas are respectively installed at one side of the closed container 3.

A drive motor 17 consisting of a stator 20 and a rotor 18 is fixedly installed between the upper frame 4 and the lower frame 4'.

A fixing (fixed) scroll 5 is combined by a bolt 5' at the upper side of the upper frame 4, and an orbiting scroll 7 is rotatably combined with the fixing scroll 5 at the lower side thereof, having a plurality of compressive chambers for compressing a coolant sucked from the suction tube 1.

A wrap W1 is formed in an involute shape at the inner surface of the fixing scroll 5, and an inlet 5*a* is formed at the outermost side of the wrap W1, communicating with the suction tube 1. An output 5*b* is formed at the upper side of the central portion of the closed container, communicating with the discharge tube 2.

A wrap W2 is engaged to be revolved on the inner surface of the orbiting scroll 6 in the fixing scroll 5.

At the lower side of the orbiting scroll 6, a drive shaft 13 is combined at the central portion of the rotor 18, penetrating the upper frame 4. The drive shaft 13 is provided with an oil passage 13*a* formed to penetrate the central portion in the length direction and an eccentric portion 3*b* formed at the upper portion thereof.

An oil feeder 16 is installed at the lower portion of the drive shaft 13 to pump oil 15 filled at the lower portion of inside the closed container 3.

A slide bush 19 is insertedly formed at the eccentric portion 13*b* of the drive shaft 13, which is varied in the radial direction and receives a rotational force of the drive shaft 13 in the tangential direction. An Oldham's ring 21 a rotation-preventing unit, is combined at the lower portion of the orbiting scroll 6 to prevent the orbiting scroll 6 from rotating.

A high pressure and low pressure separating plate 8 is fixedly installed at the upper side of the fixing scroll 5 by a plurality of bolts 22. A gas discharge hole 8*a* is formed at the central portion of the upper side of the fixing scroll 5. The inside of the closed container 3 is divided into a high pressure chamber 10 and a low pressure chamber 14 by the high and low pressure separating plate 8. At one side of the high and low pressure separating plate 8, a back pressure valve 12 is combined to partially discharge the gas of the high pressure chamber 10.

A discharge chamber 23 is formed at the upper portion of the high and low pressure separating plate 8, communicating with the gas discharge hole 8*a* and the discharge tube 2. At the side of the discharge hole 5*b*, a bypass hole 25 is formed to be connected with an intermediate pressure 24 formed between the fixing scroll 5 and the orbiting scroll 6. A bypass valve 26 is installed at the upper side of an inlet of the upper portion of the bypass hole The operation of the scroll compressor of the background art constructed as described above will now be explained.

When the rotor 18 is rotated by an applied current, the drive shaft 13 is rotated as being eccentric as long as the eccentric distance of the eccentric portion 13*b* according to the rotation of the rotor 18, so that the orbiting scroll 6 is circularly moved.

Prevented from rotating by the Oldham's ring 21, that is, the rotating-prevention unit, the orbiting scroll 6 makes turning movement centering around the drive shaft 13, drawing a turning circle at a distance apart as long as the turning radius. At this time, as the orbiting scroll 6 makes turning movement at the distance apart as long as the turning radius, a plurality of compressive chambers 7 are formed between the fixing scroll 5 and the two wraps W1 and W2.

Accordingly, a coolant gas filled in the compressive chambers 7 by being sucked through the inlet 5*a* placed at one side of the fixing scroll 5 is moved toward the center of the scrolls 5 and 6 by the continuous turning movement of the scrolls 5 and 6. While being moved, its volume is reduced to be compressed, discharged through the outlet 5*b* of the fixing scroll 5 and passed through the high and low pressure separating plate 8 to flow into the high pressure chamber 10. And this coolant gas flown into the high pressure chamber 14 is introduced to a condenser (not shown) through the discharge tube 2.

At this time in case that the pressure of the coolant being discharged to the high pressure chamber 10 is too high, the back pressure valve 12 is forced to open so as to discharge a portion of the coolant to the low pressure chamber 14, so that an abnormal over-compression can be prevented from occurring.

In addition, when the drive shaft 13 is rotated, the oil 15 is pumped by the oil feeder installed at the lower end portion of the drive shaft 13 and supplied upwardly through the oil passage 13*a*, so that a friction resistance of a thrust face 4*a* of the upper frame 4 that contacts the orbiting scroll 6 is reduced.

However, the scroll compressor of the background art has the following problem. That is, in the abnormal pressure condition due to the over-compression, the gas can be moved by the back pressure valve. But, in case that a pipe line through which the coolant is circulated is partially clogged and thus the coolant is prevented from sucking to the sucking tube, though the compression is continuously made in the compressive chamber, the pressure of the high pressure chamber does not go beyond a pre-set pressure at which the back pressure valve is operated. Consequently, the inside of the compressor becomes a vacuum state, and if this vacuum state is maintained for a certain time, the inside of the compressor becomes ultra-vacuum state, causing a short in a charging portion of the drive motor due to degradation of electric insulation, resulting in a high possibility that the drive motor is damaged and an electric shock occurs due to a leakage current.

In addition, since oil is not sufficiently supplied to the thrust face of the upper frame contacting the orbiting scroll at the initial state of driving the compressor, the contacting portion is easily abraded.

FIG. 2 shows another example of a scroll compressor in accordance with the background art.

In describing the scroll compressor, the same reference numerals are given for the same elements as in FIG. 1, for which descriptions are omitted.

As shown in the drawing, a valve stopper 3*a* is combined at the central portion of the upper surface of the fixing scroll 5, communicating with an outlet 5*b* of the fixing scroll 5. A check valve 30 is installed inside the valve stopper 3*a* to control flowing of the coolant gas of high temperature and high pressure as compressed in the compressive chamber 7, for which the check valve 30 is moved upwardly and downwardly along a guide face 'G' of the inner side of the valve stopper 3*a* to open and close the outlet 5*b* of the fixing scroll 1*a*.

A discharge hole 3*a*' is formed at the upper surface of the valve stopper 3*a*.

The operation of another example of the scroll compressor of the background art constructed as described above will now be explained.

According to the scroll compressor of the another example, in case that the scroll compressor stops operating for a short time and starts 3 r operating, the check valve 30 serves in a manner that the gas of the high pressure chamber 10 flows back to be introduced into the compressive chamber 7 formed by the wraps W1 and W2 of the fixing scroll 5 and the orbiting scroll 6 through the outlet 5*b* of the fixing scroll 5, to thereby reversely rotate the orbiting scroll 6, so that the wraps W1 and W2 can be prevented from damaging and a noise does not occur. Besides, in order to prevent a degradation of the compression efficiency, the check valve 30 clogs the outlet 5*b* to thereby prevent the orbiting scroll 6 from reversely rotating against reverse discharging.

Meanwhile, the coolant gas compressed in the compressive chamber 7 pushes up the check valve 30 placed at the front end through the outlet 5*b* of the fixing scroll 5, so as to be discharged. At this time, the check valve is moved along the inner wall of the valve stopper 3*a* to start a stroke, and as the compressor is continuously being operated, the check valve is placed in a raised position, maintaining contacting the face of the upper end portion of the valve stopper 3*a*.

Since the check valve 30 is placed in the raised position while the compressor is operated, the compressed coolant gas is discharged through the discharge hole 3*a*' of the valve stopper 3*a*. When the compressor stops operating, the discharge gas filled in the upper portion of the closed container 3 applies a force to the upper surface of the check valve 30 through the discharge hole 3*a*' of the valve stopper 3*a*, then, the check valve 30 rapidly closes the discharge hole 5*b* of the fixing scroll 5, thereby preventing the discharge gas from flowing back.

However, disadvantageously, the scroll compressor according to the second background art has a structure that in case that the compressor keeps operating in a state that the coolant does not flow into the inlet, the high-pressure discharge gas won't be bypassed toward the low pressure side, for which there is no device or structure provided in preparation for occurrence of vacuum at the suction side possibly caused when a cooling cycle is interrupted.

Accordingly, for the products adopting the scroll compressor, a service valve (not shown) is installed to connect an indoor device and an outdoor device. In this respect, if the scroll compressor is started in a state that the service valve is locked up, the coolant gas being introduced to the low pressure side gradually dies away, pushing into a high vacuum state, resulting in that a drive motor is exposed in the high vacuum, so as to be damaged due to the vacuum discharge, the temperature of the discharge gas goes up due to the high compression ratio, and the compressive unit is abraded due to shortage in supply of oil.

In addition, if such abnormal operation of the compressor is continued for a long time, vacuum of the low pressure chamber and the compressive chamber, that is, the suction pressure region, is accelerated, resulting in that a hermetic terminal (not shown) is damaged due to the vacuum compression or tip-sealing is degraded due to the re-compression by the compressive unit to be broken down. Thus, a reliability of the compressor is inevitably degraded.

SUMMARY OF THE INVENTION

Thus, in order to overcome the above problem, an object of the present invention is to provide an apparatus for preventing vacuum compression of a scroll compressor which is capable of preventing the inside of a compressor from being an ultra vacuum state when a pipe line is clogged. so that its drive motor can be prevented from breaking down, the temperature of a discharge gas due to a high compression ratio can be prevented from increasing, and a compressive unit can be protected by being successively supplied with oil.

Another object of the present invention is to provide an apparatus for preventing vacuum compression of a scroll compressor which is capable of preventing a vacuum compression of a compressor by using an intermediate pressure.

Still another object of the present invention is to provide an apparatus for preventing vacuum generation of a scroll compressor which is capable of preventing the inside of the compressor from becoming a vacuum state as well as preventing a thrust face from abrading.

In order to achieve the above objects, there is provided an apparatus for preventing vacuum compression of a scroll compressor including: a suction tube and a discharge tube each combined to one side of a closed container filled with oil to an adequate height; a fixing scroll having a wrap and a coolant inlet and an outlet; a high and low pressure separating plate installed at the upper side of the fixing scroll, dividing the inside of the closed container into a high pressure chamber and a low pressure chamber, the high and low pressure separating plate having a gas discharge hole at its central portion; an orbiting scroll having a plurality of compressive chambers for compressing a sucked coolant by;,being rotatably engaged with the wrap of the fixing scroll at the lower side of the fixing scroll, and having a wrap for rendering each compressive chamber to have different pressure to be successively moved as being turned; and a high vacuum preventing unit installed at the inner side of the body of the fixing scroll.

In order to achieve the above objects, there is also provided an apparatus for preventing vacuum compression of a scroll compressor in which the fixing scroll and the orbiting scroll are rotated in the compressive chamber to compress a coolant and oil supplied through an oil passage is supplied to a thrust face of an upper frame of the scroll compressor as a drive shaft is being rotated, including a back pressure line formed at the orbiting scroll so that a compressive chamber can communicate with the thrust face to discharge a portion of the coolant gas compressed in the compressive chamber of the scroll compressor to the low pressure chamber.

In order to achieve the above objects, there is also provided an apparatus for preventing vacuum generation of a scroll compressor in which a valve stopper is combined to the upper portion of a discharge hole formed at the fixing scroll, a check valve is installed in the scroll compressor to be moved upwardly and downwardly along a guide face of the inside of the valve stopper to control flowing of the coolant gas of high pressure and high temperature compressed in the compressive chamber, to open and close the discharge hole of the fixing scroll, including: a mutually communicating by-pass hole for by-passing a high pressured coolant gas to a low pressure side at the time when the check valve closes the discharge hole of the fixing scroll.

DETAILED DESCRIPTION OF THE PREFERRED EMBODIMENTS

Figure 1:
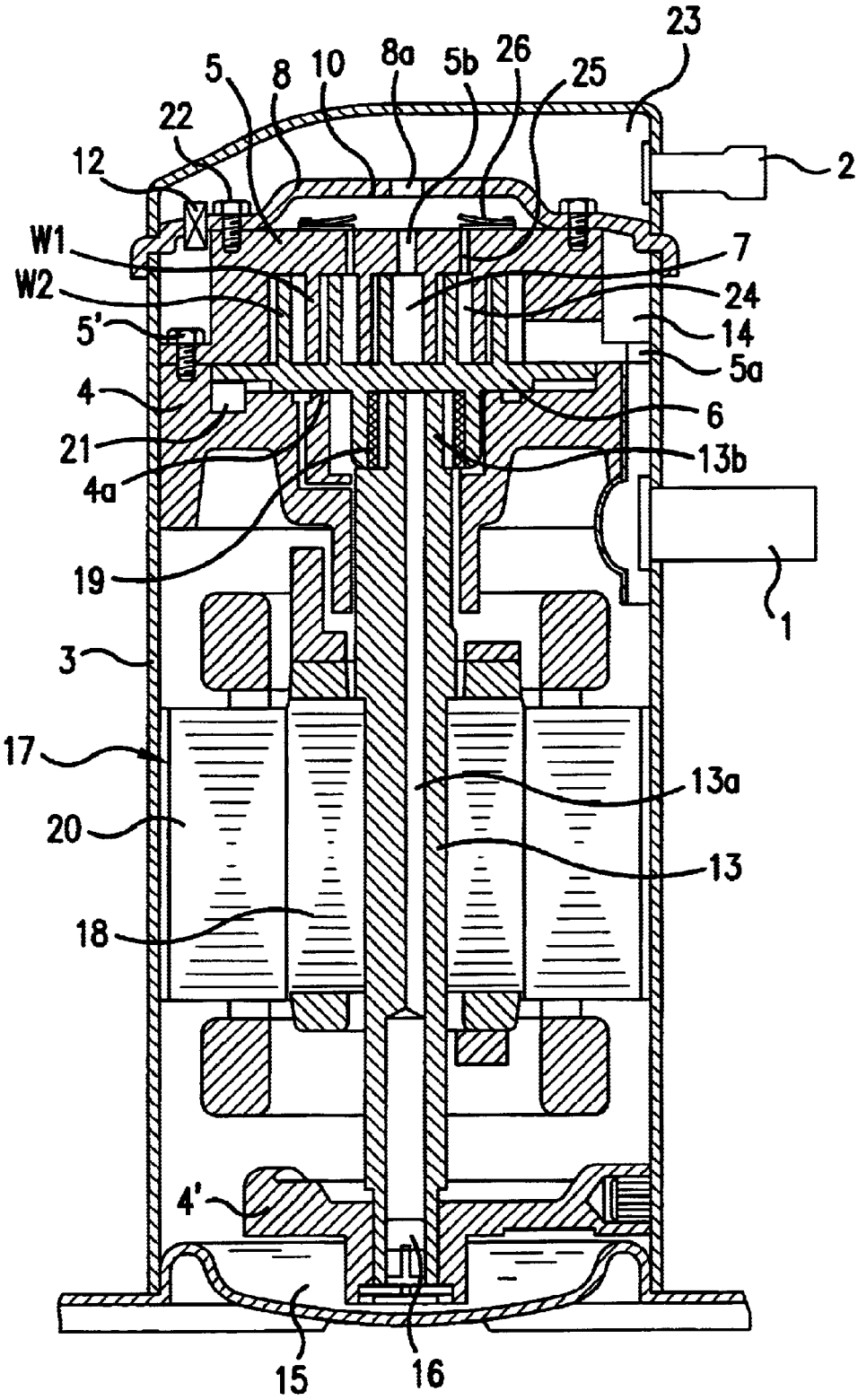
FIG.1 BACKGROUND ART
FIG. 1 is a vertical-sectional view showing one example of a scroll compressor in accordance with the background art.

The apparatus for preventing vacuum compression of a scroll compressor in accordance with a first embodiment of the present invention will now be described with reference to the accompanying drawings.

The same elements as in FIG. 1 of the background art will be given the same reference numerals, description for which are omitted.

As shown in FIGS. 3 through 5B, the apparatus for preventing vacuum compression of a scroll compressor in accordance with the first embodiment of the present invention is constructed as follows. A cylinder 120 is formed at the inner side of the fixing scroll 5 in the vertical direction.

A balance mass 121 is slidably installed inside the cylinder 120 and a coolant flow groove 121 a is formed at a predetermined portion of the outer circumferential surface of the balance mass 121. An intermediate pressure hole 122 is formed at the lower side of the balance mass, to connect the bottom surface of the cylinder 120 and a bypass hole 25.

A high pressure connection hole 123 and a low pressure connection hole 124 are respectively formed at both sides of the balance mass 121. The high pressure connection hole 123 renders the cylinder 120 to communicate with a high pressure chamber 10, and the low pressure chamber connection I hole 124 renders the cylinder 120 to communicate with a low pressure chamber 14. A communicating portion 125 is formed at one side of the upper portion of the balance mass 121, rendering the upper end portion of the cylinder 120 to communicate with the low pressure chamber 14.

The coolant flow groove 121 a is formed at a predetermined portion of the balance mass 121 at the same height of both of the high pressure chamber connection hole 123 and the low pressure chamber connection hole 124 from the bottom of the cylinder 120, so that when the balance mass 121 is positioned at the lower portion inside the cylinder 120, the coolant of the high pressure chamber 10 can flow into the low pressure chamber 14 through the coolant flow groove 121*a*.

The operation of the apparatus for preventing vacuum compression of a scroll compressor in accordance with the first embodiment of the present invention constructed as described above will now be explained.

When power is supplied and a rotor 18 of a drive motor 17 is rotated, a drive shaft 13 fixed at the rotor 18 is rotated, according to which the orbiting scroll 6 combined to the eccentric portion 13*b* of the drive shaft 13 is rotated. As the orbiting scroll 6 is rotated, the coolant gas sucked into the compressive chamber 7 through the suction tube 1 is compressed in the compressive chamber 7 that is formed when the fixing scroll 5 and the orbiting scroll 6 are rotated. The compressed coolant gas of high pressure is discharged to the discharge chamber 23 through the outlet 5*b* and sent to the condenser through the discharge tube 2 connectedly installed at the discharge chamber 23.

In the above normal operation, since the balance mass 121 is moved upwardly within the cylinder 120 by the coolant gas pressure of the intermediate pressure hole 122, coolant movement from the high pressure chamber 10 to the low pressure chamber 14 does not occur.

That is, according to the position of the balance mass 121 within the cylinder 120, the coolant may flow from the high pressure chamber 10 to the low pressure chamber 14 or not. The balance mass 121 is mainly influenced by the intermediate pressure of the coolant flown into the intermediate pressure hole 122 and the suction pressure working at the upper side of the balance mass 121 through the communicating portion 125.

The operation of the balance mass 121 will now be described in detail.

Assuming that the force working on the balance mass 121 is 'F', the intermediate pressure is 'Pm1', the suction pressure is 'Ps1', the balance weight is 'M', the force pushing the balance mass through the intermediate pressure hole is 'Fm', the force pushing down the balance mass by the suction pressure is 'Fs', the self weight of the balance mass is 'Fb(M)', the discharge pressure is 'Pd1, the diameter of the balance mass is 'D', and the friction force is '$\mu$', the following formulas are obtained.

$$F=Pm1-Ps1-M$$

$$F=Fm-Fs-Fb-(\mu Pd1\times\text{area})$$

$$Fm=Pm1\times\pi D^2/4$$

$$Fs=Ps1\times\pi D^2/r$$

$$F=(Pm1-Ps1)\times\pi D^2/4-M-\mu Pd1$$

For example, $D$=0.03 m, $M$=1 kgf, $Pm1$=15 kgf/cm$^2$, $Ps1$=5 kgf/cm$^2$, $F\mu=\mu Pd1\times$ area $$F=(15-5)\times1002\times\pi0.03^2/4-1-F\mu$$

Figure 5A:
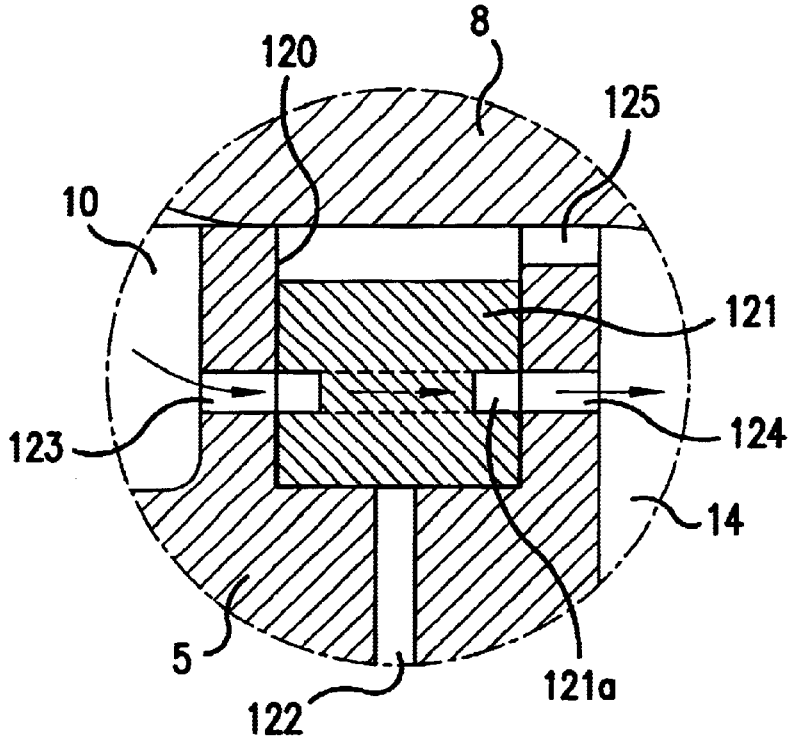
FIG. 5A is a sectional view showing an operation in case that the apparatus for preventing vacuum compression of a scroll compressor is normally performed in accordance with the first embodiment of the present invention.
Figure 5B:
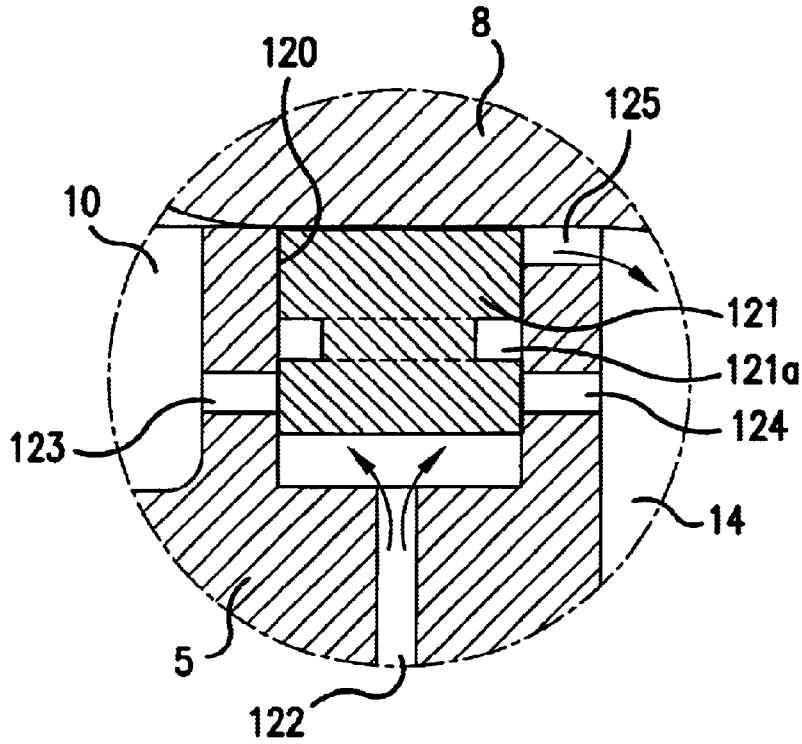
FIG. 5B is a sectional view showing an operation when the apparatus for preventing vacuum compression of a scroll compressor is performed in vacuum in accordance with the first embodiment of the present invention.

In case where F=69.7 kgf−F $\mu$>0, the balance mass 121 is attached at the upper portion inside the cylinder 120, as shown in FIG. 5B, and the coolant is blocked from flowing from the high pressure chamber 10 to the low pressure chamber 14.

Figure 8:
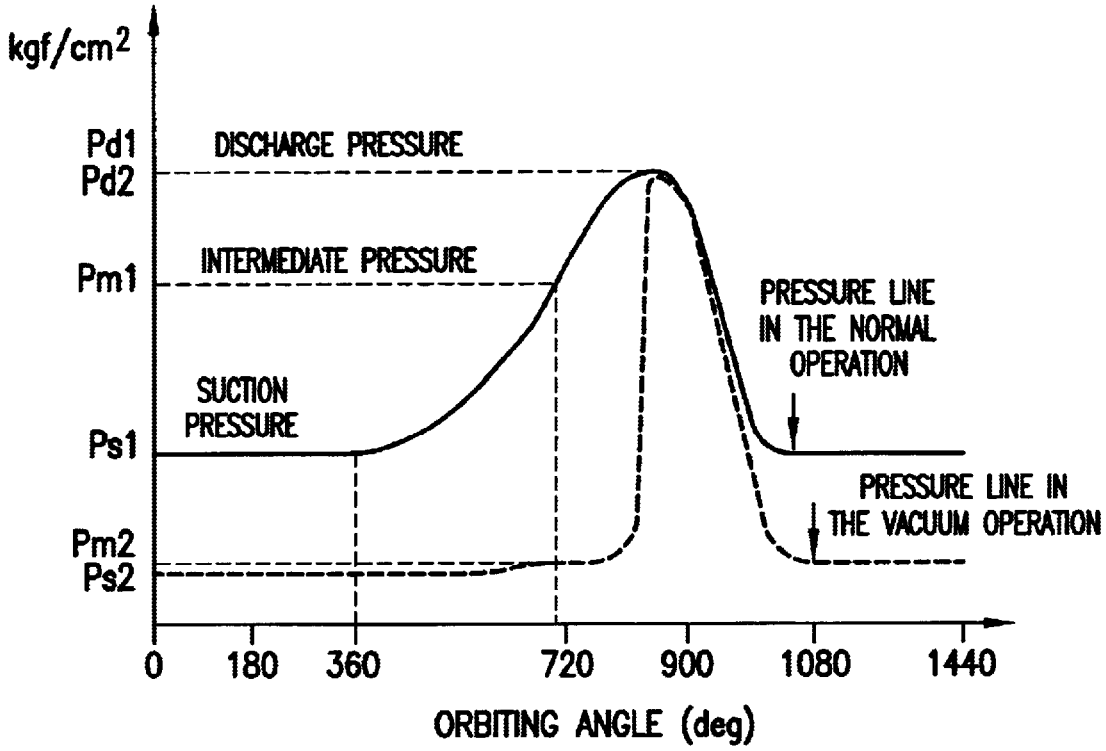
FIG. 8 is a graph showing a pressure line of a compressor adopting the apparatus for preventing vacuum compression of a scroll compressor in accordance with the first embodiment of the present invention.

That is, during the normal operation as shown by the pressure line in FIG. 8, the balance mass is pushed up by the compressed intermediate pressure (Pm1), so that there is no need to flow the coolant from the high pressure chamber 10 to the low pressure chamber 14.

However, in case that a portion of the pipe line is clogged and thus the compressive chamber 7 is vacuumized, assuming that the intermediate pressure is 'Pm2' and suction pressure is 'Ps2, since the intermediate pressure and the suction pressure are similar to each other as shown in the graph of FIG. 8, Pm$^2$ −Ps$^2$=0 kgf/cm$^2$.

Accordingly, since −1 kgf+F$\mu$<0, the balance mass 121 dropped down to the low side of the cylinder 120, as shown in FIG. 5, due to the self weight of the balance mass 121, so that the coolant of the high pressure chamber 10 is bypassed to the low pressure chamber through the coolant flow groove 121*a* of the balance mass 121.

Therefore, the coolant that was bypassed toward the low pressure chamber 14 is compressed again in the compressive chamber 7, thereby preventing the ultra vacuum state.

Figure 6:
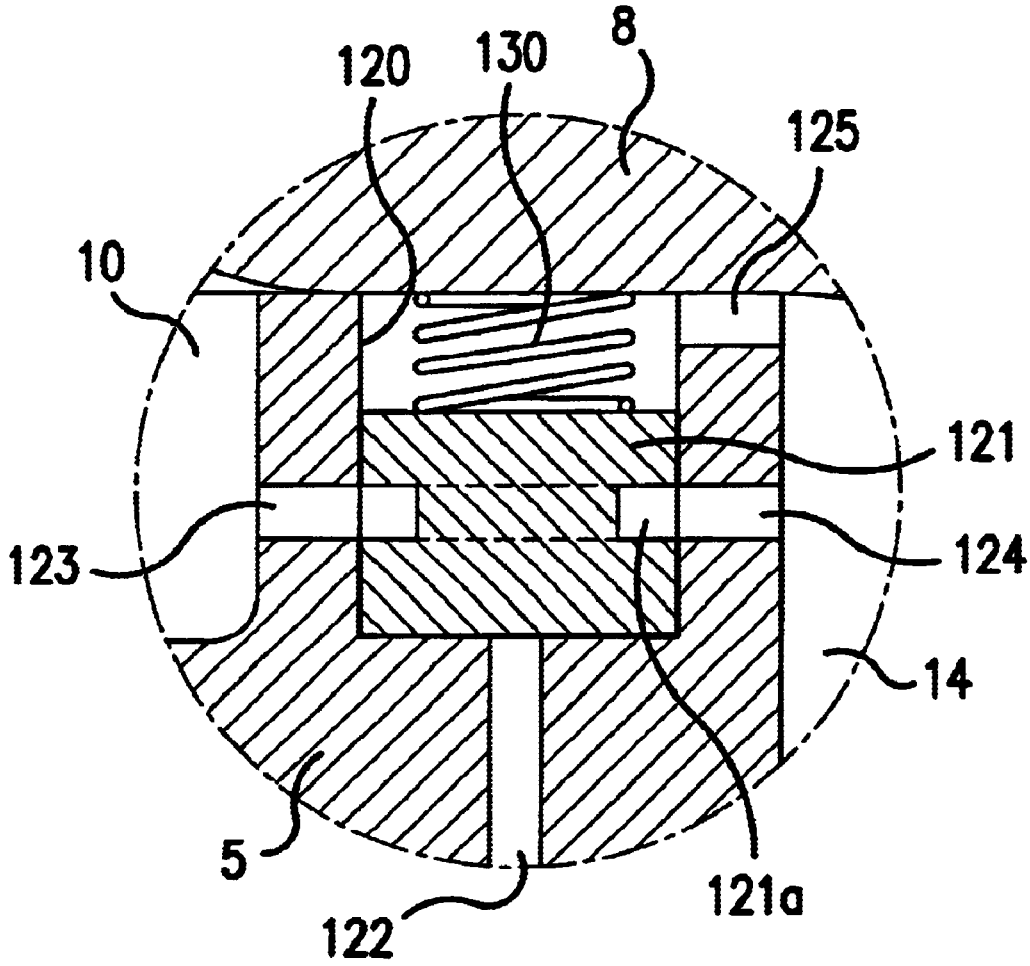
FIG. 6 is a sectional view of a modified apparatus for preventing vacuum compression of a scroll compressor in accordance with the first embodiment of the present invention.

FIG. 6 is a sectional view of a modified apparatus for preventing vacuum compression of a scroll compressor in accordance with the first embodiment of the present invention.

Figure 4:
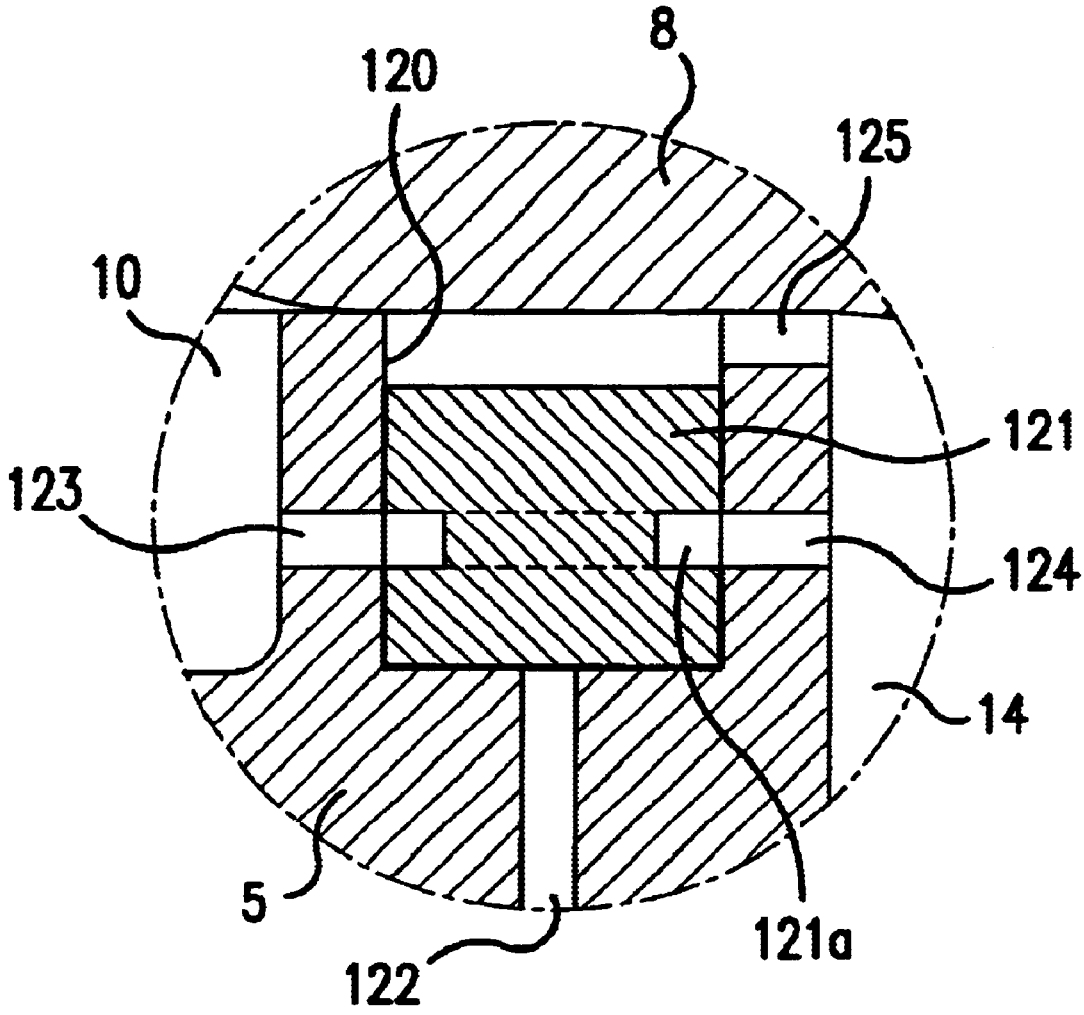
FIG. 4 is a detailed sectional view of the portion 'IV' of FIG. 3 in accordance with the first embodiment of the present invention.

As shown in the drawing, its basic structure is the same as that of FIG. 4 except a spring 130 installed at the upper portion within the cylinder 120 to elastically support the balance mass 121 downwardly, so that when the balance mass 121 is to be moved downwardly, the spring 130 pushes it regularly.

In case of the installation of the spring 130, assuming that force of the spring is 'Fk'.

$$F=Pm1-Ps1-M-Fk$$

$$F=Fm-Fs-Fb-Fk-(\mu Pd1\times\text{area})$$

$$Fm=Pm1\times\pi D^2/4$$

$$Fs=Ps1\times\pi D^2/4$$

$$Fk=k\times m^2\ (m^2\text{: displacement } m)$$

$$F=(Pm1-Ps1)\times\pi D^2/4-M-km^2-\mu Pd1$$

For example, $D$=0.03 m, $M$=1 kgf, $k\times m^2$=2 kgf, $Pm1$=15 kgf/cm$^2$, $Ps1$=5kgf/cm$^2$ $$F\mu=\mu Pd1\times\text{area}$$

$$F=(15-5)\times1002\times\pi03^2/4-I-2-F\mu$$

Figure 7A:
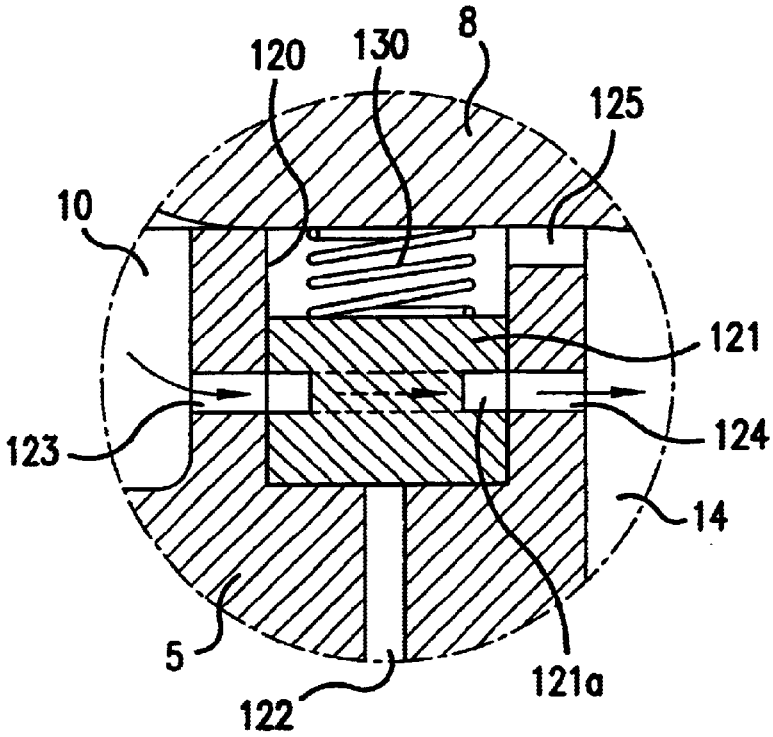
FIG. 7A is a view showing a normal operation of the modified apparatus for preventing vacuum compression of a scroll compressor of FIG. 6 in accordance with the first embodiment of the present invention.
Figure 7B:
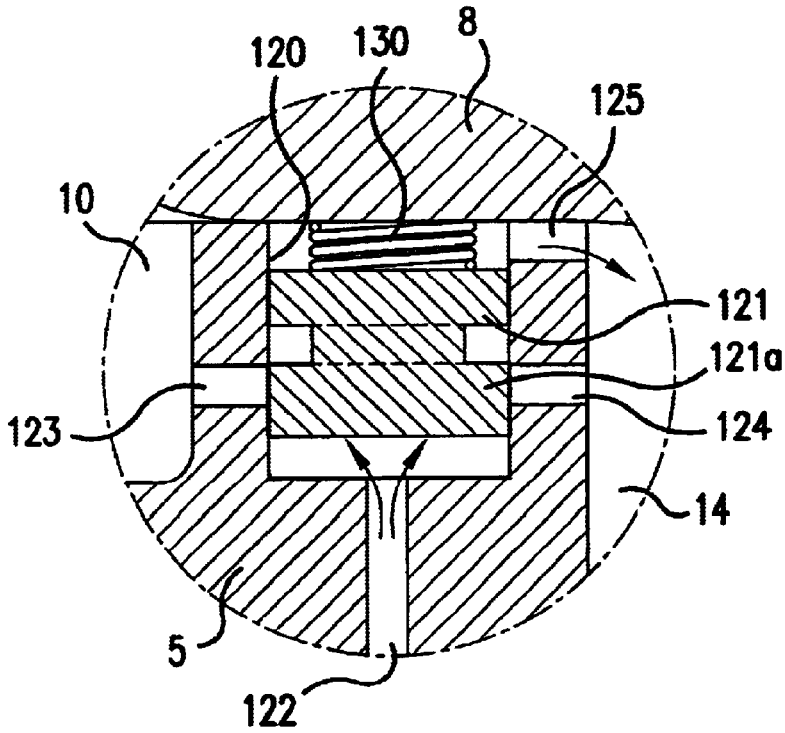
FIG. 7B is a view showing an operation in a vacuum compression of FIG. 6 in accordance with the first embodiment of the present invention.

In case that F=67.7 kgf−F$\mu$>0, it signifies the normal operation that the pipe line is not clogged. In this state, as shown in FIG. 7B, the balance mass 121 is attached to the upper portion, overcoming the force pushed by the spring 130 inside the cylinder 120, and the coolant is blocked from flowing from the high pressure chamber 10 to the low pressure chamber 14.

That is, as shown FIG. 8 illustrating a graph of the pressure line, in the normal operation, since the balance mass 121 is pushed up by the intermediate pressure Pm1, the coolant of the high pressure chamber 10 does not need to be flown to the low pressure chamber 14.

Meanwhile, in case that a portion of the pipe line is clogged and thus the compressive chamber 7 is vacuumized, since the intermediate pressure and the suction pressure are similar to each other as shown in the graph of FIG. 8. Pm$^2$ −ps$^2$=0 kgf/cm$^2$. Thus, −3 kgf+F$\mu$<0, so that the balance mass 121 is moved downwardly in the cylinder 120 as shown in FIG. 7A due to the self weight and the force pushed by the spring 130. Then, the coolant of the high pressure chamber 10 is bypassed toward the low pressure chamber 14 through the coolant flow groove 121*a* of the balance mass 121, and the coolant bypassed to the low pressure chamber 14 is compressed again in the compressive chamber 7, thereby preventing ultra vacuum state from occurring.

Accordingly, by adjustably dropping down the balance mass 121 in the cylinder 120 by adjusting the weight of the balance mass 121 or controlling the elastic modulus of the spring 130, even through the pipe line is clogged, the compressor is prevented from being an ultra vacuum state at a proper time, so that the equipment can be prevented from sudden-downing.

An apparatus for preventing vacuum compression of a scroll compressor in accordance with a second embodiment of the present invention will now be described.

In describing the scroll compressor, the same reference numerals are given for the same elements as in FIG. 1, for which descriptions are omitted.

Figure 9:
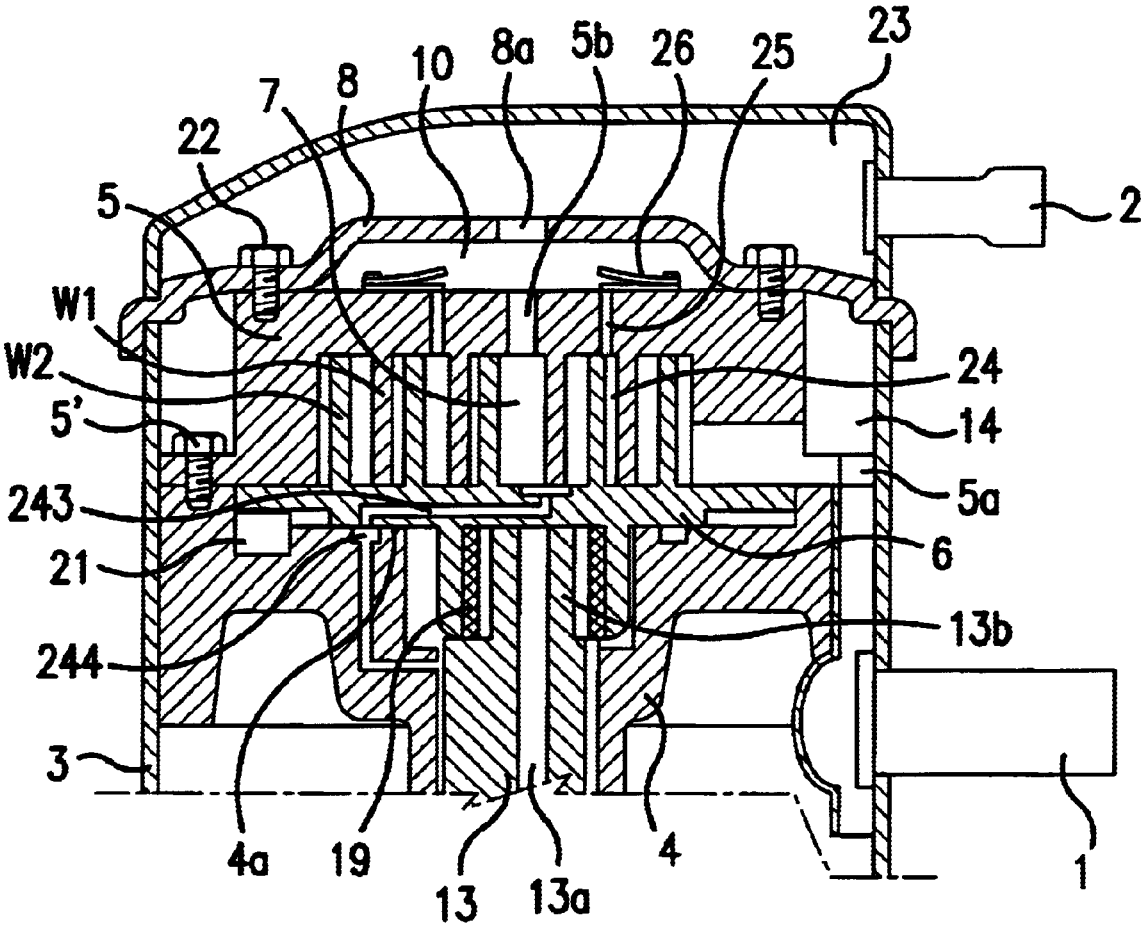
FIG. 9 is a vertical-sectional view showing an apparatus for preventing vacuum compression of a scroll compressor in accordance with a second embodiment of the present invention.

The apparatus for preventing vacuum compression of a scroll compressor in accordance with the second embodiment of the present invention is featured in that, as shown in FIG. 9, a back pressure line 243 is formed inside the orbiting scroll 6, rendering the compressive chamber 7 to communicate with the thrust face 4*a* of the upper frame 4, so that a portion of coolant of the compressive chamber 7 can be leaked to the low pressure chamber 14 through the back pressure line 243.

A lower storage recess 244 is formed in a circle form at the upper surface of the upper frame 4, that is, at the low side of an outlet port of the back pressure line 243, to store oil included in the cold air leaked to the back pressure line 243.

As for the apparatus for preventing vacuum compression of scroll compressor in accordance with the second embodiment of the present invention, during the normal operation, the coolant flown in the compressive chamber 7 through the suction tube 1 by the orbiting scroll 6 that is rotated according to the rotation of the drive shaft 13 is compressed in the compressive chamber 7, and the compressed coolant is discharged to the high pressure chamber 10 through the discharge hole 5*b* and the gas discharge hole 8*a* so as to be discharged through the discharge tube 2. The oil is supplied through the oil passage 13*a* formed at the drive shaft 13 to the friction surface such as the thrust face 4*a* of the upper frame 4.

Meanwhile, in the abnormal operation that the pipe is clogged and thus the coolant gas is not flown in while the compression is continuously being made in the compressive chamber 7, a portion of the coolant compressed in the compressive chamber 7 is leaked through the back pressure line 243, which is then leaked to the low pressure chamber 14 passing through the contact face between the upper frame 4 and the orbiting scroll 6, which is re-supplied to the compressive chamber 7, thereby preventing the vacuum state in the low pressure chamber 14.

A very small quantity of oil included in the coolant that is discharged to the back pressure line 243 is stored in the lower storage recess 244 formed at the upper surface of the upper frame 4. The stored oil is supplied to the thrust face 4*a* where the upper frame 4 and the orbiting scroll 6 contact each other so that it is sufficiently lubricated, and especially the abrasion due to a shortage of lubrication can be much reduced in the initial driving.

The apparatus for preventing vacuum compression on scroll compressor in accordance with the third embodiment of the present invention will now be described with reference to the accompanying drawings.

Figure 2:
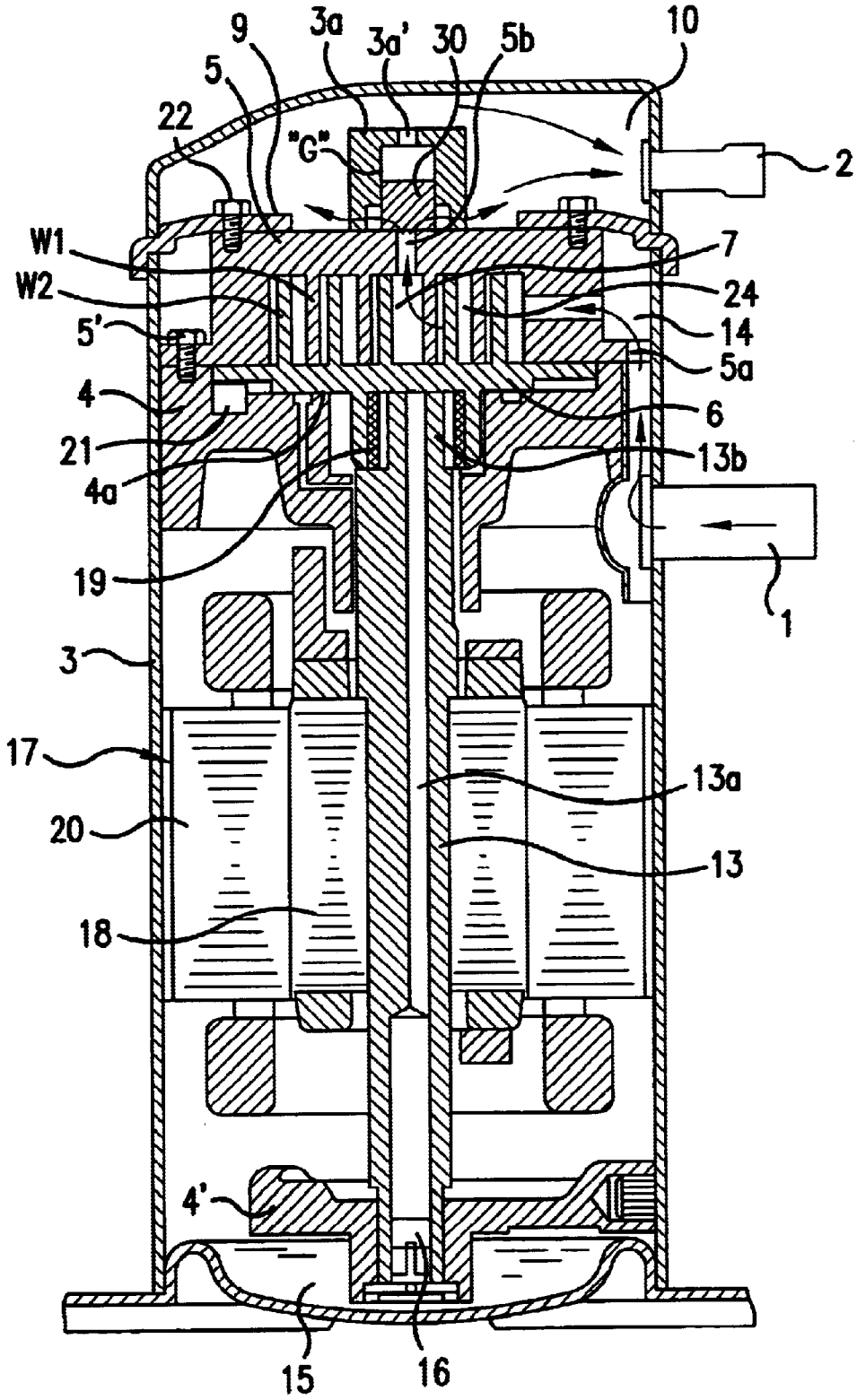
FIG.2 BACKGROUND ART
FIG. 2 is a vertical-sectional view showing another example of a scroll compressor in accordance with the background art.
Figure 3:
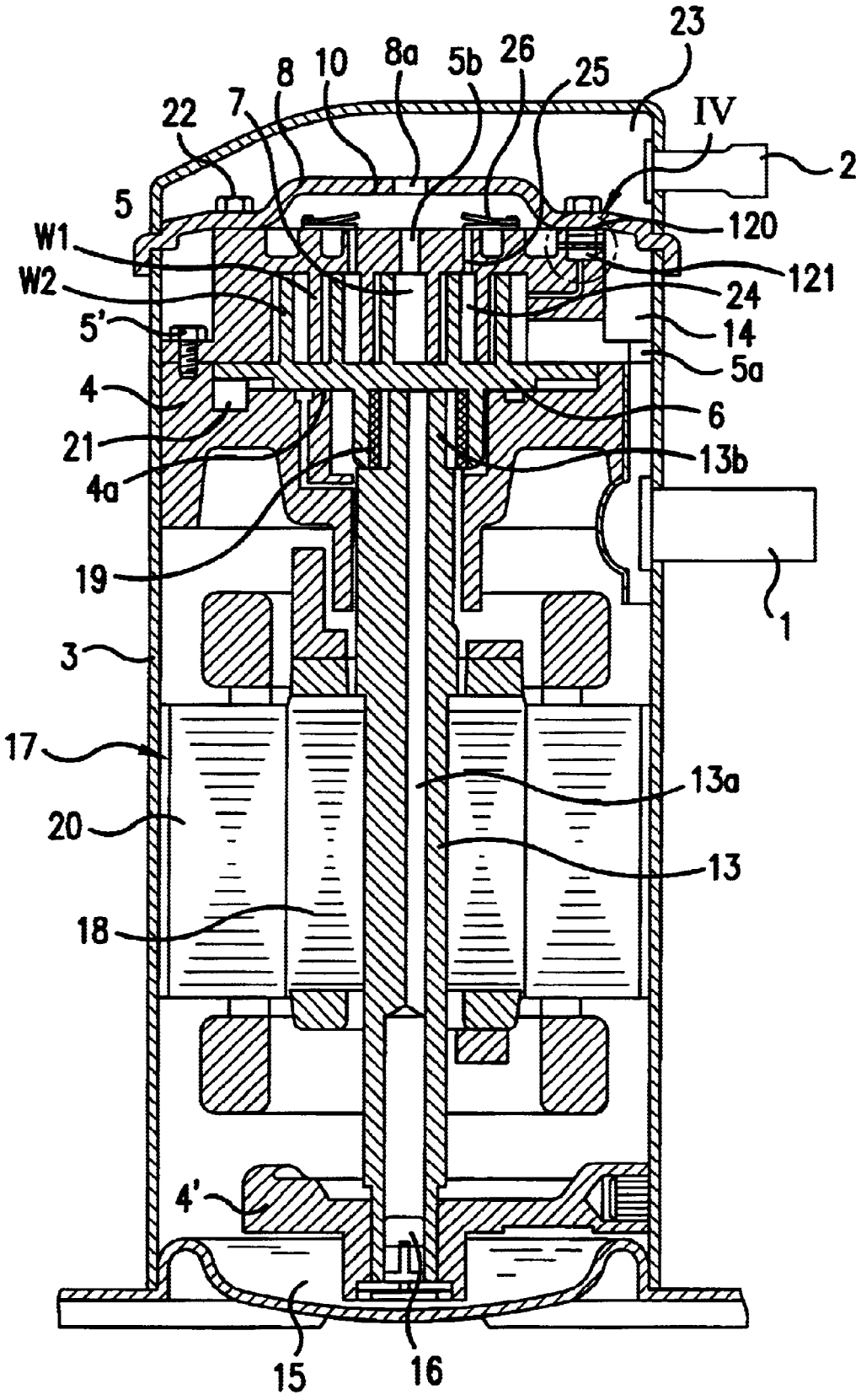
FIG. 3 is a vertical-sectional view showing an apparatus for preventing vacuum compression of a scroll compressor in accordance with first embodiment of the present invention.

In describing the scroll compressor, the same reference numerals are given for the same elements as in FIG. 2, for which descriptions are omitted.

Figure 10:
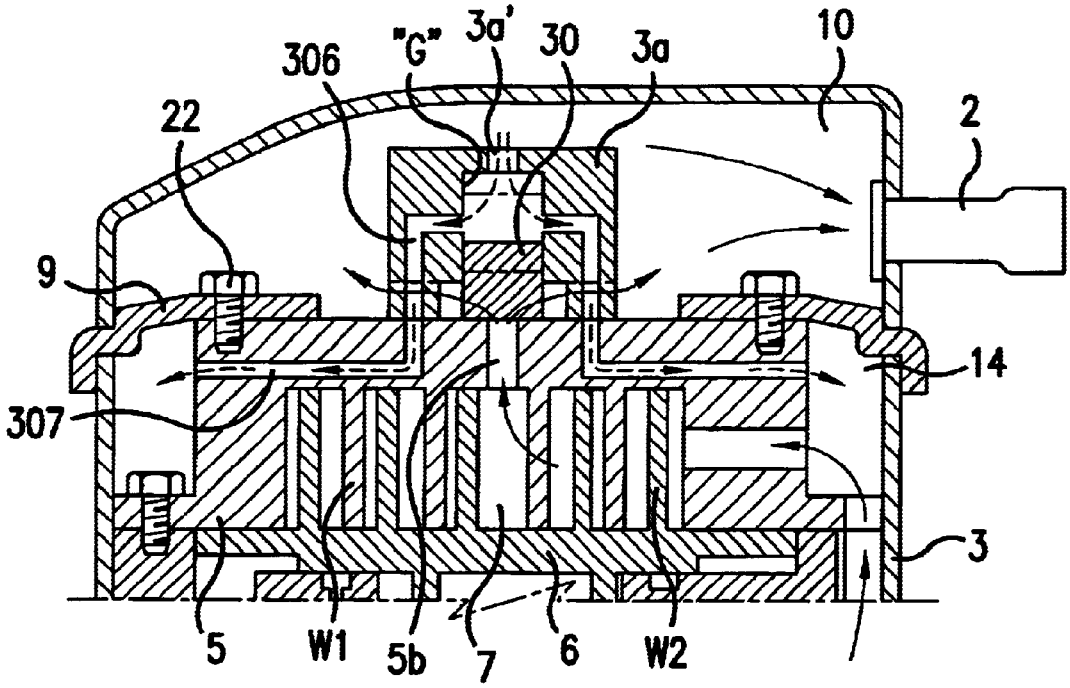
FIG. 10 is a vertical-sectional view showing an apparatus for preventing vacuum compression of a scroll compressor in accordance with a third embodiment of the present invention.

As shown in FIG. 10, at least one by-pass holes 306 and 307 are formed at the inner side of the valve stopper 3*a* combined at the upper side of the outlet 5*b* formed at the fixing scroll 5 installed in the scroll compressor. The by-pass holes mutually communicate to bypass the high pressured coolant gas to the low pressure side at the time when the check valve 30 closes the outlet 5*b* of the fixing scroll 5. The by-pass hole 306 that is formed at the inner side of the valve stopper 3*a* to be opened and closed by the check valve 30 is formed at such a position that it can be opened as the check valve 30 is lowered down and nears the fixing scroll 5.

The operational principle of the apparatus for preventing vacuum compression of a scroll compressor is based on the difference in the up and down displacement amount of the check valve 30 within the valve stopper 3*a* combined to the upper portion of the outlet 5*b* of the fixing scroll 5 according to the pressure and the flow amount of the coolant gas when the sucked coolant gas is compressed and discharged through the outlet 5*b* of the fixing scroll 5. When the suction path is clogged or the service valve is not opened in installment of the product, the flow amount of the compressed coolant gas becomes very small.

At this time, the low pressure chamber 14 separated by the high pressure separating plate 9 combined at the upper surface of the fixing scroll 5 within the closed container 3 becomes a high vacuum state, and the pressure of the coolant gas and the discharge flow amount of the coolant gas serving to push up the check valve 30, are lowered down, so that the check valve 30 is adhered near the outlet 5*b* of the fixing scroll 5 or is away as long as a very short distance.

At this time, as the check valve 30 is lowered down, the by-pass hole 306 formed inner side of the valve stopper 3*a* is opened, the high-pressured coolant gas of the high pressure chamber 10 flows through the discharge hole 3*a* of the valve stopper 3*a*, the by-pass hole 306 and the by-pass hole 307 of the fixing scroll 5 to the low pressure chamber 14, so that the pressure of the low pressure chamber 14 is increased, thereby preventing a high vacuum or a high pressure ratio from occurring.

During the normal operation of the scroll compressor, since the check valve 30 is raised due to the sufficient compressive gas flow amount and pressure, the by-pass hole 306 formed at the valve stopper 3*a* is blocked by the raised check valve 30, so that the normal operation can be performed without leaking coolant gas to the suction side.

Figure 11:
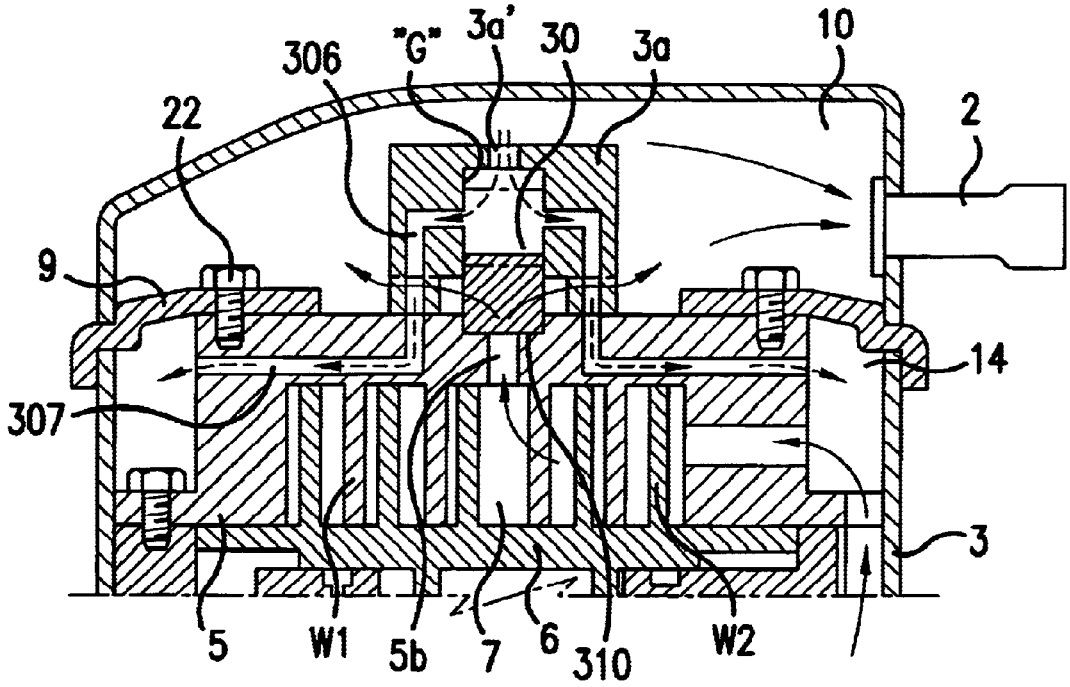
FIG. 11 is a vertical-sectional view showing one modification of an apparatus for preventing vacuum compression of a scroll compressor in accordance with a third embodiment of the present invention.

FIG. 11 is a vertical-sectional view showing one modification of an apparatus for preventing vacuum compression of a scroll compressor in accordance with a third embodiment of the present invention. This modification is featured in that a guide groove 310 is formed on which the check valve 30 is integrally mounted on the upper portion of the outlet 5*b* of the fixing scroll, so that when the coolant gas starts discharging after the check valve 30 goes completely off from the guide groove 310 integrally formed at the upper portion of the outlet 5*b* of the fixing scroll 5.

That is, since a starting point for discharge of the coolant gas can be extended as deep as the guide groove 310, the displacement amount difference of the check valve 30 is made big, so that formation of a by-pass path can be easy and characteristics of the vacuum prevention operation can be improved.

Figure 12:
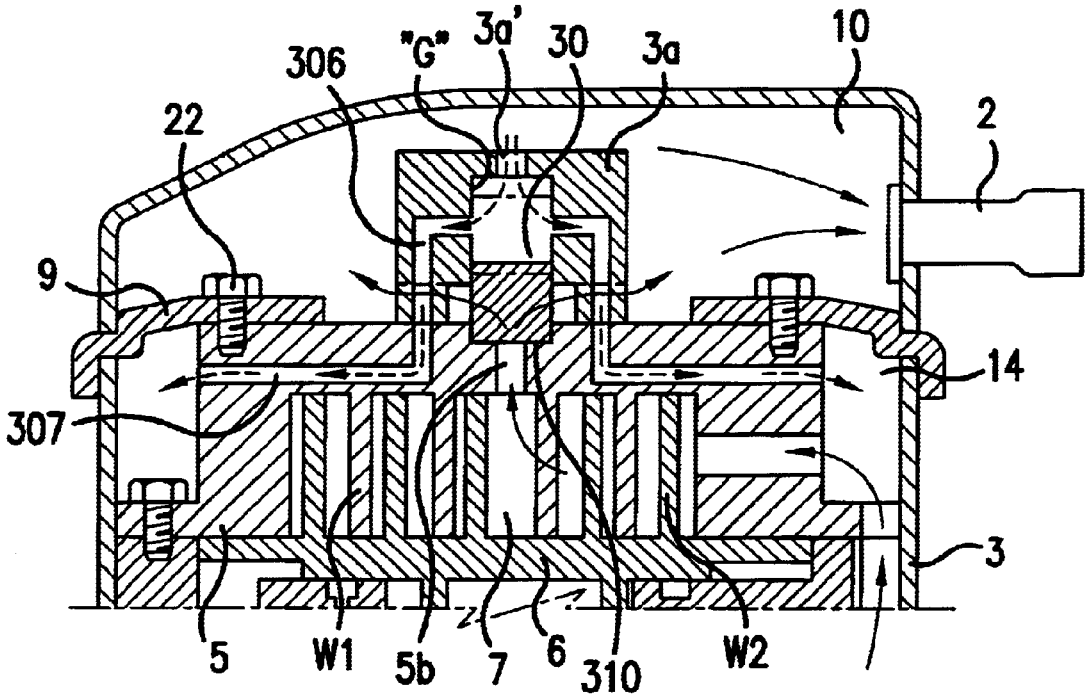
FIG. 12 is a vertical-sectional view showing another modification of an apparatus for preventing vacuum compression of a scroll compressor in accordance with a third embodiment of the present invention.

FIG. 12 is a vertical-sectional view showing another modification of an apparatus for preventing vacuum compression of a scroll compressor in accordance with a third embodiment of the present invention.

As shown in the drawing, the another modification is featured in that the guide groove 310 on which the check valve 30 is integrally mounted is formed at the upper side of the outlet 5*b* of the fixing scroll 5, and the plural by-pass holes are formed in different sizes at the inner side of the valve stopper 3*a*.

Accordingly, due to the pressure difference between the by-pass holes in difference sizes, the check valve 30 contacts one side of the inner side of the valve stopper 3*a* to be thereby moved stably. And, leakage of high pressure coolant gas to an opening between the check valve 30 and the valve stopper 3*a* is prevented.

Figure 13:
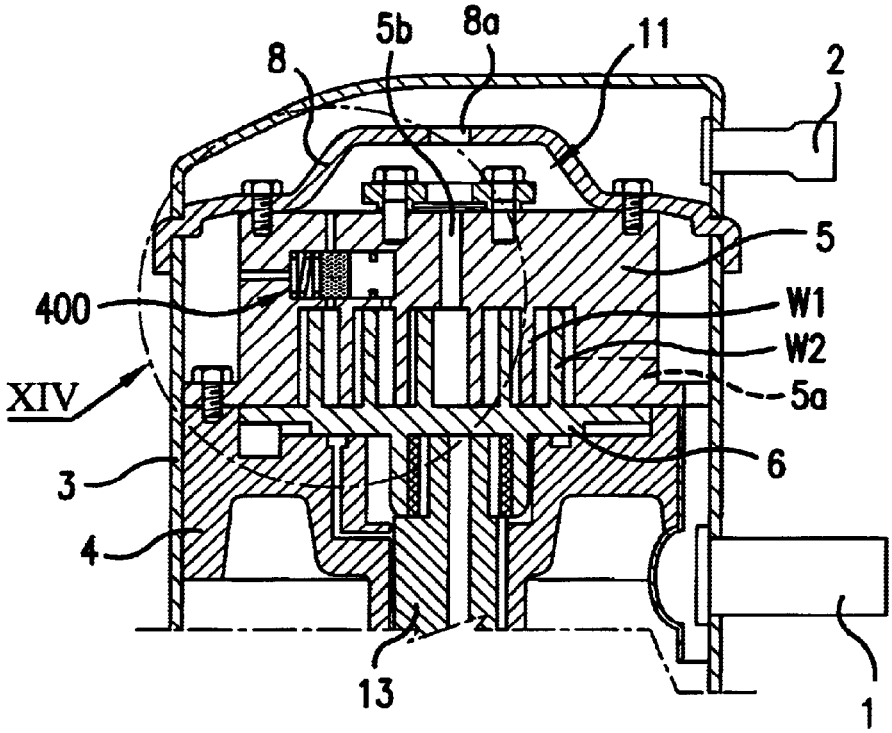
FIG. 13 is a partial vertical-sectional view showing an apparatus for preventing vacuum compression of a scroll compressor in accordance with a fourth embodiment of the present invention.
Figure 14:
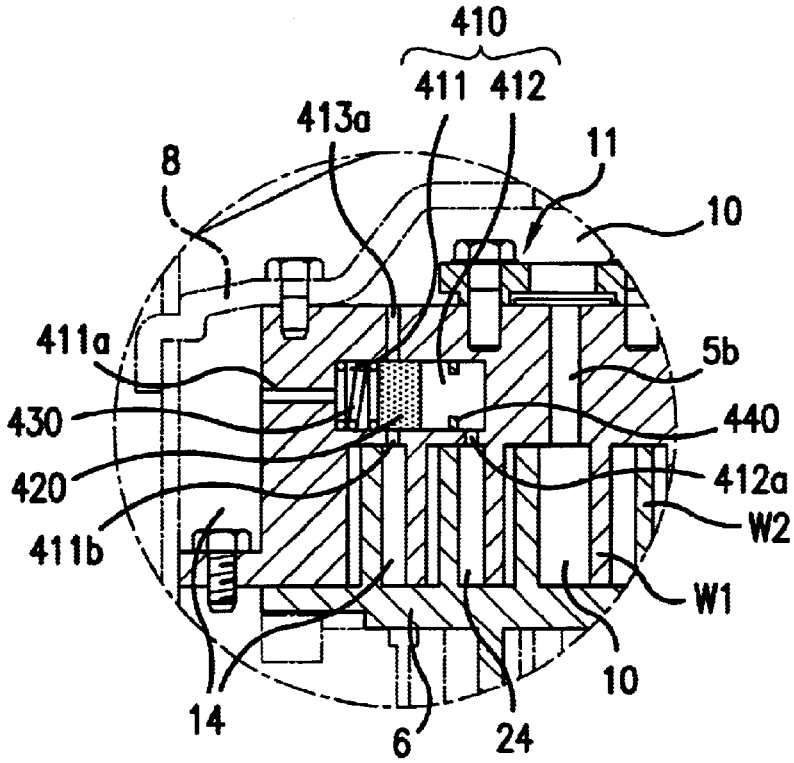
FIG. 14 is an enlarged view showing a 'XIV' portion of FIG. 13 of the apparatus for preventing vacuum compression of a scroll compressor in accordance with the fourth embodiment of the present invention.

FIG. 13 is a partial vertical-sectional view showing an apparatus for preventing vacuum compression of a scroll compressor in accordance with a fourth embodiment of the present invention, and FIG. 14 is an enlarged view showing a 'XIV' portion of FIG. 13 in accordance with the fourth embodiment of the present invention.

In descriptions for the fourth embodiment of the present invention, the same reference numerals are given for the same elements as those in FIG. 1 and descriptions therefor are omitted.

The apparatus for preventing vacuum compression of a scroll compressor in accordance with the fourth embodiment of the present invention is featured in that a high vacuum prevention unit 400 is provided at the fixing scroll 5 fixed at the upper frame 4 disposed inside the closed container 3.

The high vacuum prevention unit 400 includes a valve housing 410 formed inside the body of the fixing scroll 5, a valve member 420 slidably inserted into the valve housing 410 to communicate or block the low pressure chamber 14, a suction pressure region of the closed container 3, and the high pressure chamber 10, a discharge pressure region of the closed container 3, and an elastic member 430 inserted between the valve housing 410 and the valve member 420 to add an elastic force to the sliding motion of the valve member 420.

The valve housing 410 is formed to be a horizontal-directional valve drift space which is divided into a suction pressure space 411 and an intermediate pressure space 412 by the valve member 420. A first suction pressure-sided gas hole 411 a is formed at one side of the suction pressure space 411, communicating with the low pressure chamber 14 of the closed container 3, and an intermediate pressure-sided gas hole 412 a is formed at the circumferential surface of the intermediate pressure space 412, communicating with the intermediate pressure chamber 24, that is, the intermediate pressure region of the closed container 3.

A discharge pressure-sided gas hole 413*a* is formed at the upper side of the circumferential surface of the valve housing 410, communicating with the high pressure chamber 10 of the closed container 3. The discharge-pressure-sided gas hole 413*a* is opened and closed by the valve member 420.

A C-ring 440 is inserted in the inner circumferential surface of the valve housing 410 or a protrusion (not shown) is formed, to prevent the intermediate pressure-sided gas hole 412*a* from blocking by the valve member 430.

The suction pressure-sided gas hole 411*a* is penetratingly formed to the outer circumferential surface of the fixing scroll 5. The intermediate press-sided gas hole 412*a* is penetratingly formed to the intermediate pressure chamber 24 among the plurality of compressive chambers formed by the orbiting scroll 6 and the fixing scroll 5. The discharge pressure gas hole 413*a* is penetratingly formed to the upper surface of the fixing scroll 5.

A second suction press-sided gas hole 411*b* may be additionally formed at the circumferential surface of the valve housing 410, which is opened and closed by the valve member 420 along with the discharge pressure-sided gas hole 413*a*. It is preferred that the second suction pressure-sided gas hole 411*b* is penetratingly formed to the low pressure chamber 14 among the plurality of compressive chambers formed by the orbiting scroll 6 and the fixing scroll 5.

The valve member 420 is slidably inserted to the inner circumferential surface of the valve housing 410, and an O-ring (not shown) is inserted to the outer circumferential surface for sealing with the valve housing 410.

As a compressive coil spring, the elastic member 430 is introduced into the suction pressure space of the valve housing 410, or may be introduced to the intermediate pressure space 412 of the valve housing 410.

The operation of the apparatus for preventing vacuum compression of a scroll compressor in accordance with the fourth embodiment of the present invention constructed as described above will now be explained.

Figure 15A:
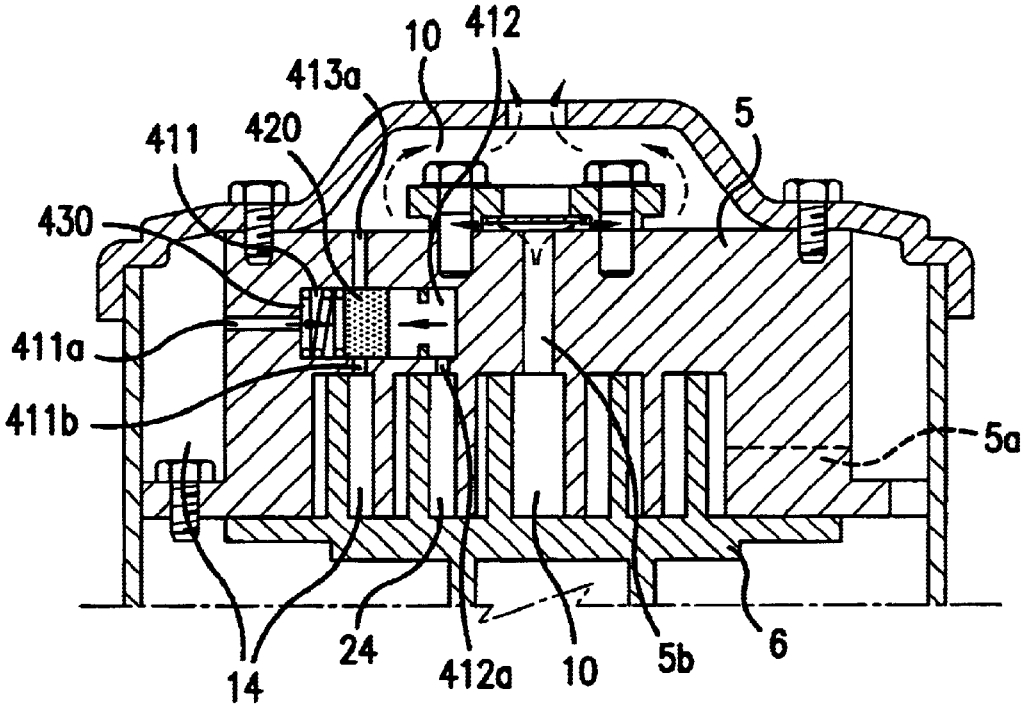
FIG. 15A is a partial vertical-sectional view showing a normal operation in the apparatus for preventing vacuum compression of a scroll compressor in accordance with the fourth embodiment of the present invention.
Figure 15B:
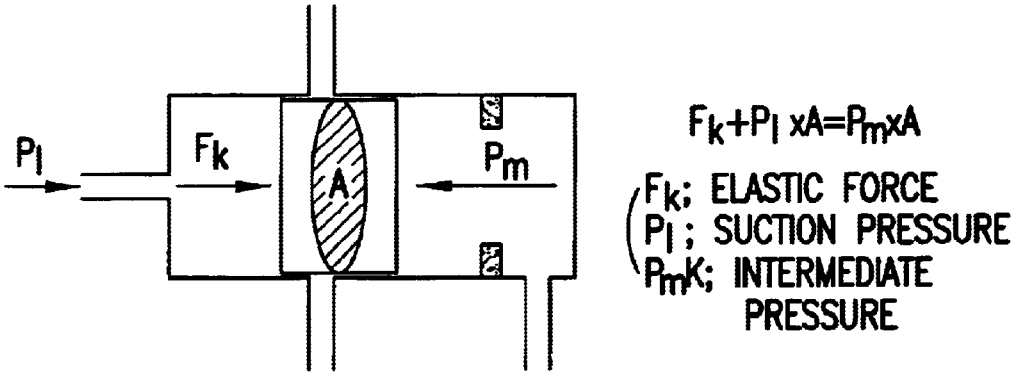
FIG. 15B is an explanatory view for showing a normal operation in the apparatus for preventing vacuum compression of a scroll compressor in accordance with the fourth embodiment of the present invention.

FIG. 15A is a partial vertical-sectional view showing a normal operation in the apparatus for preventing vacuum compression of a scroll compressor in accordance with the fourth embodiment of the present invention, and FIG. 15B is an explanatory view for showing a normal operation in the apparatus for preventing vacuum compression of a scroll compressor in accordance with the fourth embodiment of the present invention.

As shown in the drawings, during a normal operation of the compressor, since the coolant gas flows into the intermediate pressure space 412 of the valve housing 410 through the intermediate pressure-sided gas hole 412*a* to push the intermediate pressure receiving face of the valve member 430, the pressure load (Pm×A) applied to the intermediate pressure receiving face of the valve member 420 is balanced with the force adding the elastic force (Fk) of the elastic member 430 applied to the back side and the compression load (PI×A) of the low pressure chamber 14, so that the valve member 420 blocks the discharge pressure-sided gas hole 413*a*.

In this manner, the high pressure gas of the high pressure chamber 10 flown to the suction pressure space 411 of the valve housing 410 through the discharge pressure-sided gas hole 41 3*a* is prevented from flowing back to the low pressure chamber 14 through the suction pressure-sided gas hole 411*a*.

Figure 16A:
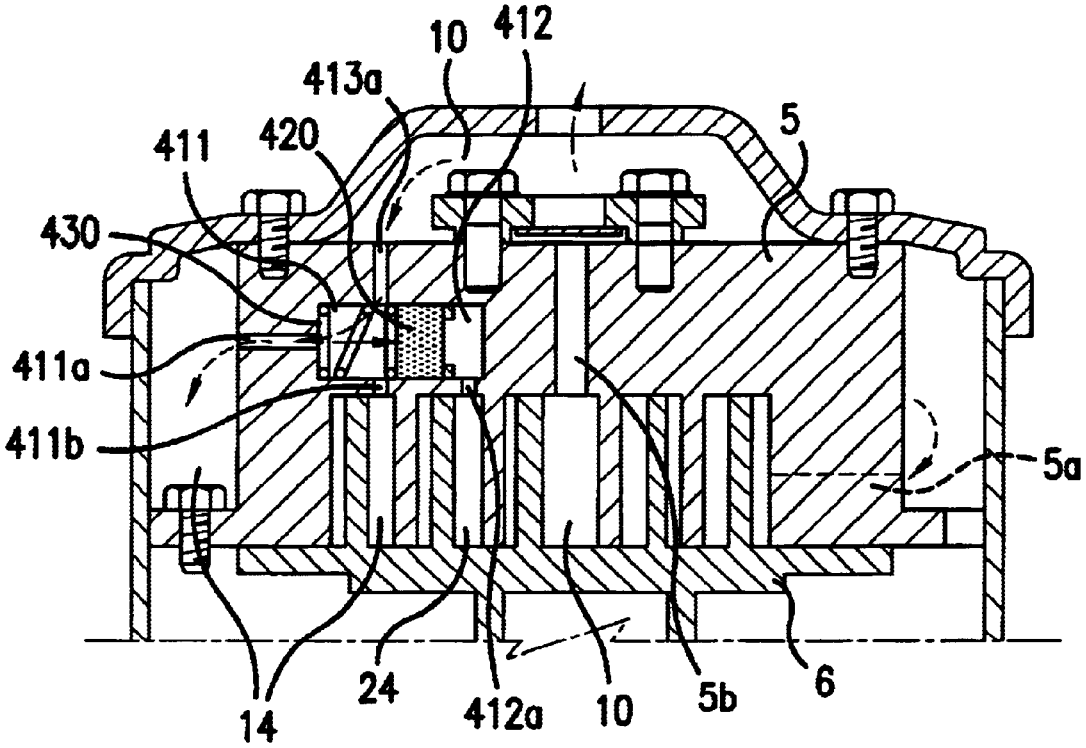
FIG. 16A is a partial vertical-sectional view showing an abnormal operation (high vacuum operation) in the apparatus for preventing vacuum compression of a scroll compressor in accordance with the fourth embodiment of the present invention.
Figure 16B:
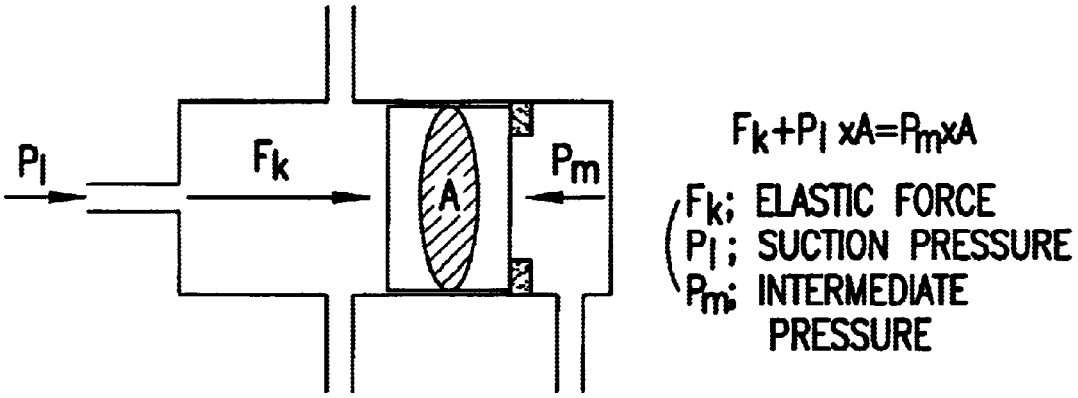
FIG. 16B is an explanatory view for showing an abnormal operation (high vacuum operation) in the apparatus for preventing vacuum compression of a scroll compressor in accordance with the fourth embodiment of the present invention.

FIG. 16A is a partial vertical-sectional view showing an abnormal operation (high vacuum operation) in the apparatus for preventing vacuum compression of a scroll compressor in accordance with the fourth embodiment of the present invention; and FIG. 16B is an explanatory view for showing an abnormal operation (high vacuum operation) in the apparatus for preventing vacuum compression of a scroll compressor in accordance with the fourth embodiment of the present invention.

As shown in the drawings, in case that the compressor is over-pressured or in case of pump down, the coolant gas of the low pressure chamber 14 and of the compressive chambers are wholly discharged to the high pressure chamber 10, rendering the intermediate pressure chamber 24 of the compressive chamber and the intermediate pressure space 412.of the valve housing 110 to be a vacuum state, and a pressure load (Pm×A) applied to the intermediate pressure receiving face of the valve member 420 is smaller than the force adding the elastic force (Fk) of the elastic member 430 applied to the back side and the pressure load (PI×A) of the low pressure chamber 14. Thus, the valve member 420 is pushed to the C-ring 440 or the protrusion (not shown), opening the discharge pressure-sided gas hole 41 3*a* (or, together with other suction pressure-sided gas hole).

At the same time, a portion of the discharge gas of the high pressure chamber 10 flows into the suction pressure space 411 of the valve housing 410 through the discharge pressure-sided gas hole 413*a* and then flows back to the low pressure chamber 14 through the suction pressure-sided gas hole 411*b*, so that the vacuum state of the compressor is released.

Thereafter, the valve member 420 overcomes the force adding the pressure load (PI×A) of the low pressure chamber 14 and the electric force (Fk) of the elastic member 430 by virtue of the coolant gas flown into the low pressure chamber 14, and is pushed back to the suction pressure space 411, blocking the suction pressure-sided gas hole 411*a* and the discharge pressure-sided gas hole 41 3*a*.

Meanwhile, during the vacuum compression of the compressor, as long as power is not turned off, the drive motor 17 of the compressor is constantly rotated, so that the operation that the compressor is vacuum-pressured and released from the vacuum-compression state by the vacuum prevention unit 400 is repeatedly performed, according to which the valve member 420 performs a successive reciprocal movement with a certain frequency within the valve housing 410.

As described above, the compressive chamber 7 as well as the low pressure chamber 14 of the closed container 3 is prevented from vacuumizing, and thus, damage of the hermetic terminal due to a vacuum compression can be prevented. And, parts are prevented from degrading caused when the compression mechanism unit is re-compressed, and thus, reliability of the compressor is improved.

Figure 17:
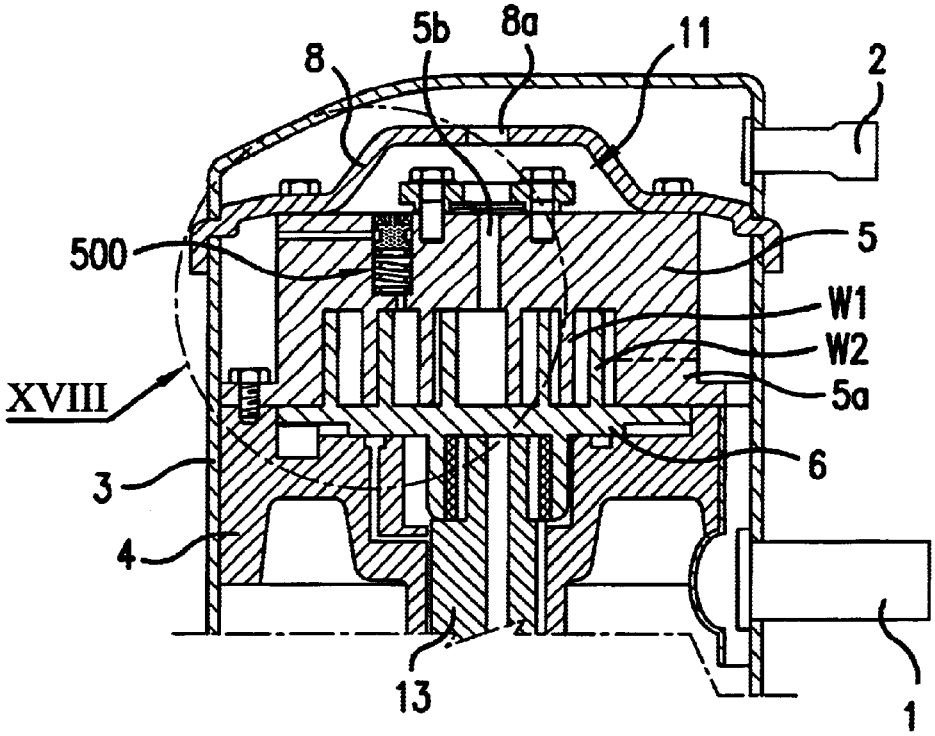
FIG. 17 is a partial vertical-sectional view showing an apparatus for preventing vacuum compression of a scroll compressor in accordance with a fifth embodiment of the present invention.
Figure 18:
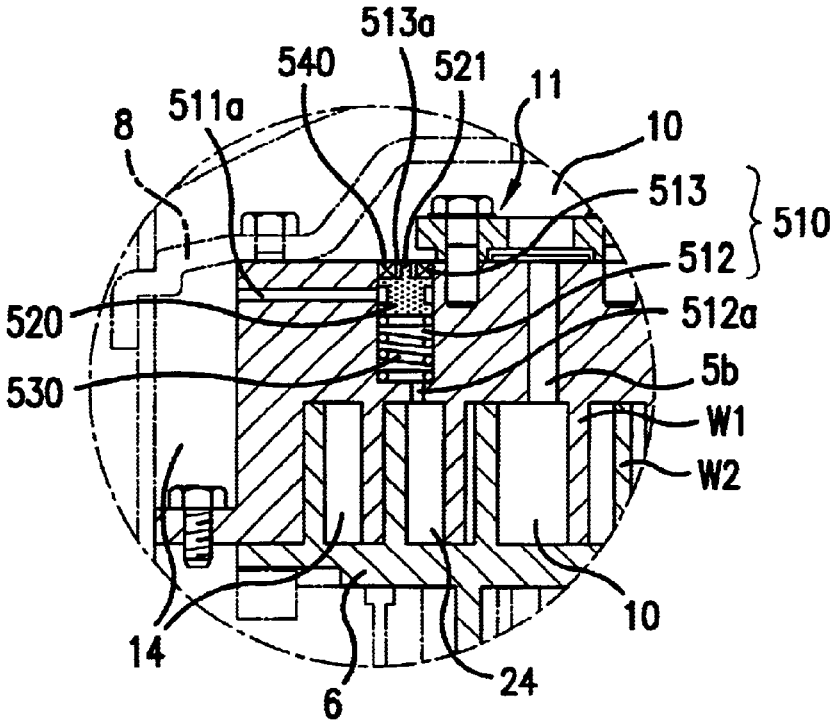
FIG. 18 is an enlarged view of the 'XVIII' of FIG. 17 in accordance with the fifth embodiment of the present invention.

FIG. 17 is a partial vertical-sectional view showing an apparatus for preventing vacuum compression of a scroll compressor in accordance with a fifth embodiment of the present invention and FIG. 18 is an enlarged view of the 'XVIII' of FIG. 17 in accordance with the fifth embodiment of the present invention.

In descriptions for the fifth embodiment of the present invention, the same reference numerals are given for the same elements as those in FIGS. 15A and 15B, and descriptions therefor are omitted.

In the fifth embodiment of the present invention, a valve housing 510, there are provided a valve member 520 and an elastic member 530. As shown in FIGS. 17 and 18, the valve housing 510 is a vertical-directional valve drift space that is divided into an intermediate pressure space 512 and a discharge pressure space 513 by the valve member 520.

A suction pressure-sided gas hole 511*a* is formed at the circumferential surface of the valve housing 510, being opened and closed by the circumferential surface of the valve member 520 to communicated with the low pressure chamber 14 of the closed container 3. An intermediate pressure-sided gas hole 512*a* is formed at the bottom of the intermediate pressure space 512, communicating with the intermediate pressure chamber 24 of the closed container 3. A discharge pressure-sided gas hole 513*a* is formed at the upper surface of the discharge pressure space 513, communicating with the high pressure chamber 10 of the closed container 3 as well as being opened and closed by the valve member 520.

The suction pressure-sided gas hole 511*a* is penetratingly formed to the outer circumferential surface of the fixing scroll 5. The intermediate pressure-sided gas hole 512*a* is penetratingly formed to the intermediate pressure chamber 24 among the plurality of compressive chambers formed by the orbiting scroll 6 and the fixing scroll 5. And, the discharge pressure gas hole 513*a* is penetratingly formed to the upper surface of the fixing scroll 5.

The upper surface of the valve housing 510 is opened and closed by a circular housing stopper 540. At the central portion of the housing stopper 520, the discharge pressure-sided gas hole 513*a* is formed. In this respect, it is preferred that the discharge pressure-sided gas hole 513*a* has a smaller diameter than the cross-sectional area of the suction pressure receiving face of the valve member 520.

The valve member 520 is slidably inserted to the inner circumferential surface of the valve housing 510, and an O-ring (not shown) is inserted to the outer circumferential surface for sealing with the valve housing 510. A protrusion 521 is formed at the upper surface corresponding to the inner end of the discharge pressure-sided gas hole 513*a*. The volume protrusion 521 is slidably inserted into the discharge pressure-sided gas hole 51 3*a*, reducing a dead volume.

The elastic member 530 is inserted in the intermediate pressure space 512 of the valve housing 510. During a normal operation of the compressor, it is preferred that the valve member 520 is adhered to the inner bottom surface of the housing stopper 540 so as to have the length of removal of the discharge pressure space 513 inside the valve housing 510.

The operation of the apparatus for preventing vacuum compression of a scroll compressor in accordance with a fifth embodiment of the present invention will now be explained with reference to FIGS. 19A and 19B.

Figure 19A:
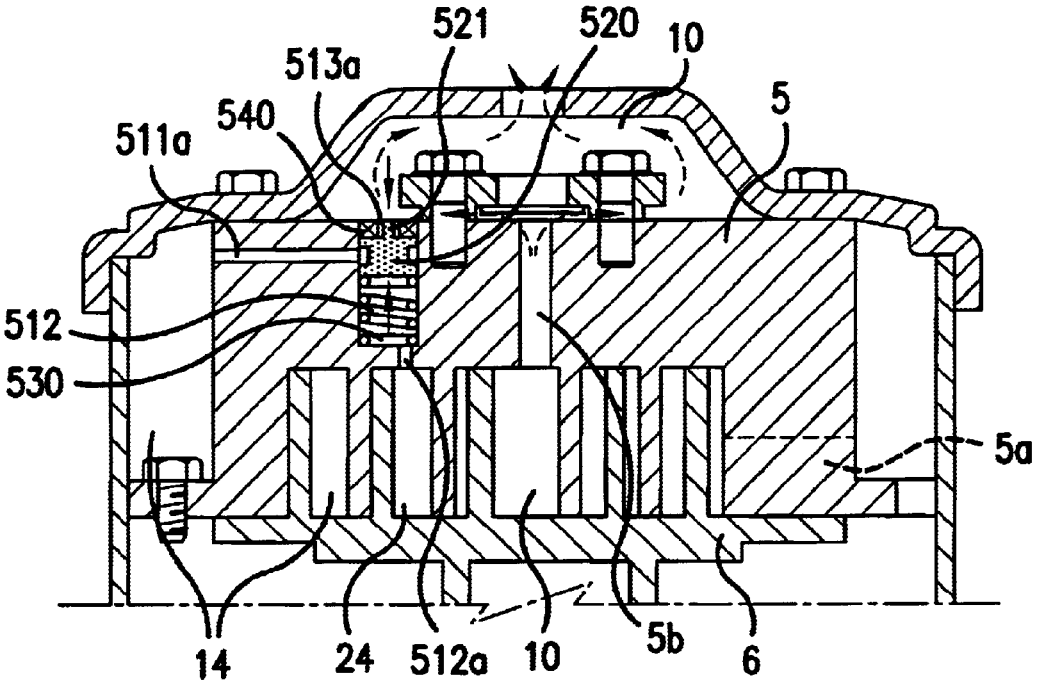
FIG. 19A is a partial vertical-sectional view showing a normal operation in the apparatus for preventing vacuum compression of a scroll compressor in accordance with the fifth embodiment of the present invention.
Figure 19B:
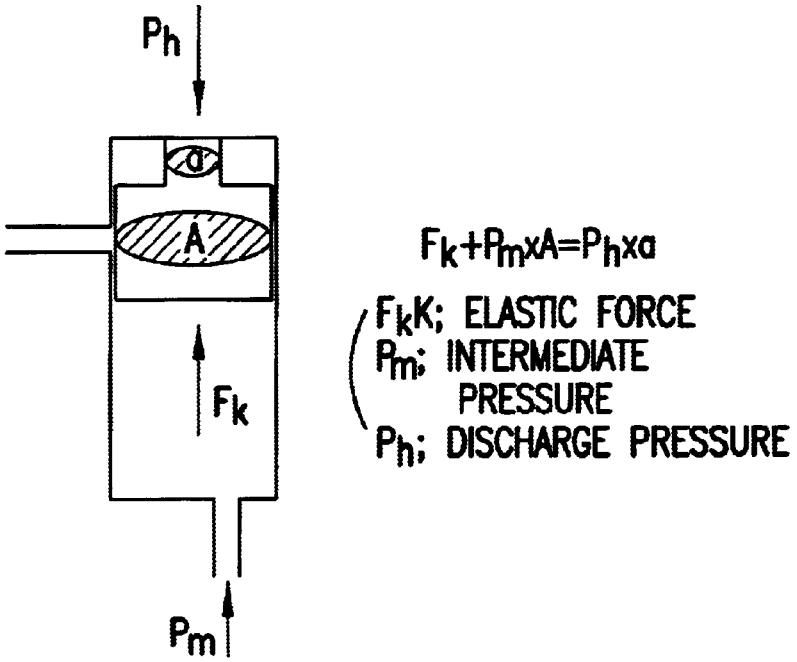
FIG. 19B is an explanatory view for showing a normal operation in the apparatus for preventing vacuum compression of a scroll compressor in accordance with the fifth embodiment of the present invention.

FIG. 19A is a partial vertical-sectional view showing a normal operation in the apparatus for preventing vacuum compression of a scroll compressor in accordance with the fifth embodiment of the present invention; and FIG. 19B is an explanatory view for showing a normal operation in the apparatus for preventing vacuum compression of a scroll compressor in accordance with the fifth embodiment of the present invention.

As shown in the drawings, during a normal operation of the compressor, the coolant gas flows into the intermediate pressure space 512 of the valve housing 510 through the intermediate pressure-sided gas hole 512*a* to push the intermediate pressure receiving face of the valve member 530, so that the force adding the pressure load (Pm×A) applied to the intermediate pressure receiving face of the valve member 520 and the elastic force (Fk) of the elastic member 530 becomes greater than or the same as the pressure load (Ph×A) of the high pressure chamber 10 applied to the back side, resulting in that the valve member 520 blocks the discharge pressure-sided gas hole 513*a*.

In this manner, the high pressure gas of the high pressure chamber 10 flown to the discharge pressure space 513 of the valve housing 510 through the discharge pressure-sided gas hole 513*a* is prevented from flowing back to the low pressure chamber 14 through the suction pressure-sided gas hole 511*a*.

At this time, the volume protrusion 521 of the valve member 520 is slidably inserted into the discharge pressure-sided gas hole 513*a*, reducing a dead volume of the high pressure chamber 10.

Figure 20A:
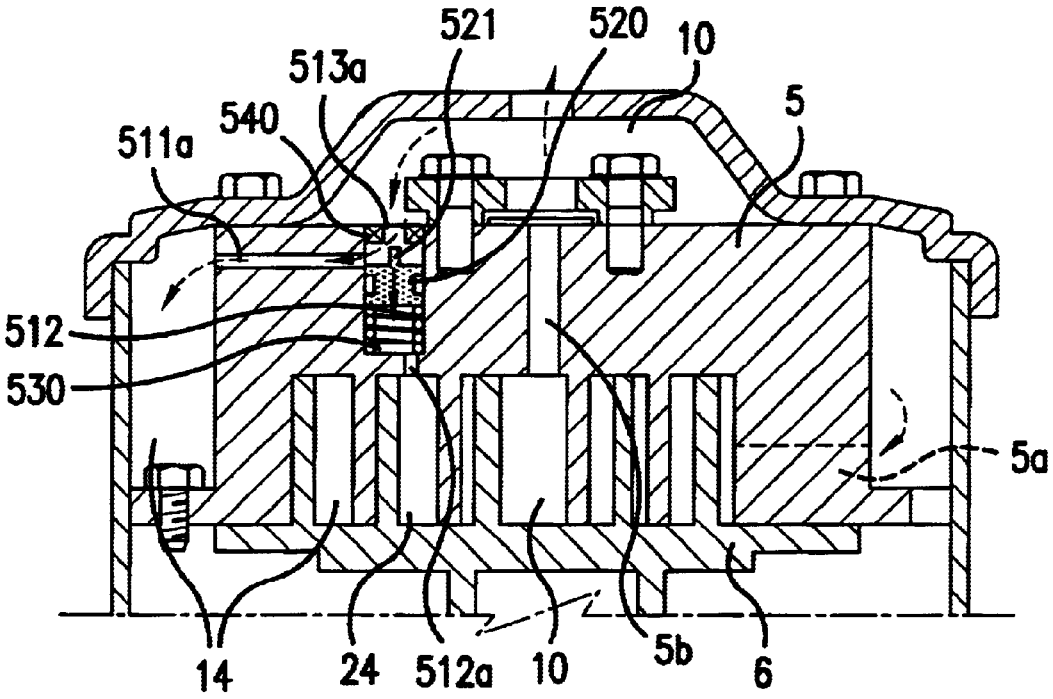
FIG. 20A is a partial vertical-sectional view showing an abnormal operation (high vacuum operation) in the apparatus for preventing vacuum compression of a scroll compressor in accordance with the fifth embodiment of the present invention.
Figure 20B:
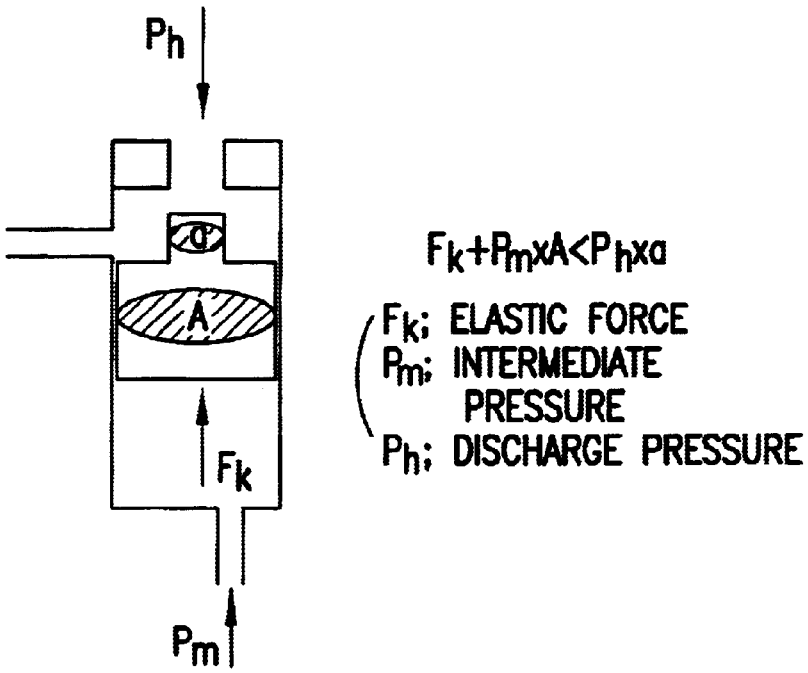
FIG. 20B is an explanatory view for showing an abnormal operation (high vacuum operation) in the apparatus for preventing vacuum compression of a scroll compressor in accordance with the fifth embodiment of the present invention.

FIG. 20A is a partial vertical-sectional view showing an abnormal operation (high vacuum operation) in the apparatus for preventing vacuum compression of a scroll compressor in accordance with the fifth embodiment of the present invention, and FIG. 20B is an explanatory view for showing an abnormal operation (high vacuum operation) in the apparatus for preventing vacuum compression of a scroll compressor in accordance with the fifth embodiment of the present invention.

As shown in the drawings, in case that the compressor is over-pressured or in case of pump down, the coolant gas of the low pressure chamber 14 and of the compressive chambers are wholly discharged to the high pressure chamber 10, rendering the intermediate pressure chamber of the compressive chamber and the intermediate pressure space 512 of the valve housing 510 to be a vacuum state, and a force adding the pressure load (Pm×A) applied to the intermediate pressure receiving face of the valve member 520 and the elastic force (Fk) of the elastic member 530 becomes smaller than the pressure load (Ph×A) applied to the back side. Resultantly, the valve member 520 is pushed to the intermediate pressure space 512. opening the discharge pressure-sided gas hole 513*a*.

And, at the same time, a portion of the discharge gas of the high pressure chamber 10 flows into the discharge pressure space 513 of the valve housing 510 through the discharge pressure-sided gas hole 513*a* and then flows back to the low pressure chamber 14 through the suction pressure-sided gas hole 511*a*, so that the vacuum state of the compressor is released.

Thereafter, the valve member 520 overcomes the pressure load (Ph×A) of the high pressure chamber 10 by virtue of the coolant gas flown into the low pressure chamber 14, and is pushed back to the discharge pressure space 513, blocking again the suction pressure-sided gas hole 511*a* and the discharge pressure-sided gas hole 513*a*.

Meanwhile, during the vacuum compression of the compressor, as long as power is not turned off, the drive motor 17 of the compressor is constantly rotated, so that the operation that the compressor is vacuum-pressured and released from the vacuum-compression state by the vacuum prevention unit 500 is repeatedly performed, according to which the valve member 520 performs a successive reciprocal movement with a certain frequency within the valve housing 510.

As described above, the compressive chamber as well as the low pressure chamber of the closed container is prevented from a vacuum state, so that hermetic terminal is prevented from damaging possibly caused due to the vacuum state. In addition, parts is prevented from degrading caused when the compression mechanism unit is re-compressed, and thus, reliability of the compressor is improved.

Figure 21:
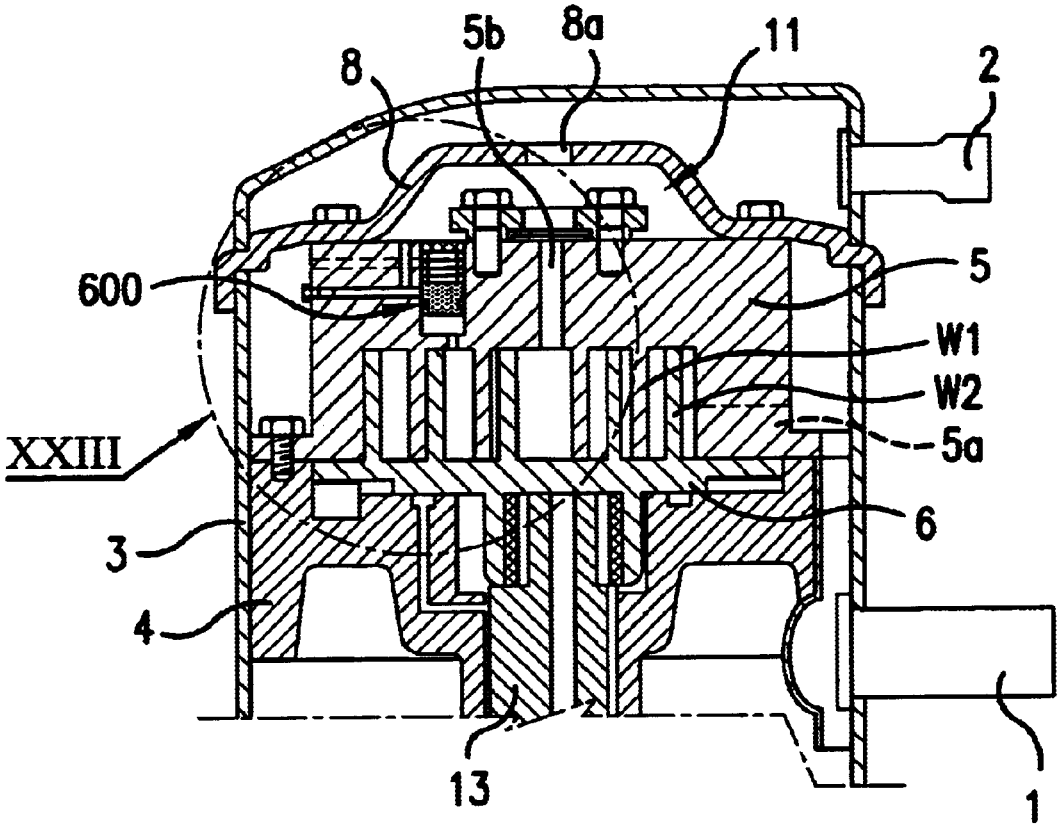
FIG. 21 is a partial vertical-sectional view showing an apparatus for preventing vacuum compression of a scroll compressor in accordance with a sixth embodiment of the present invention.
Figure 22:
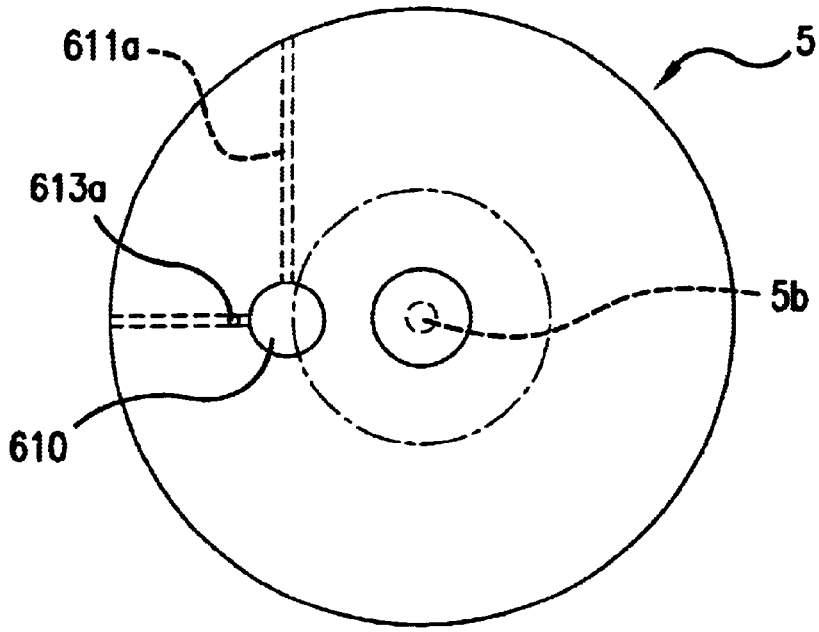
FIG. 22 is a plan view of a fixing scroll of apparatus for preventing vacuum compression of a scroll compressor in accordance with the sixth embodiment of the present invention.
Figure 23:
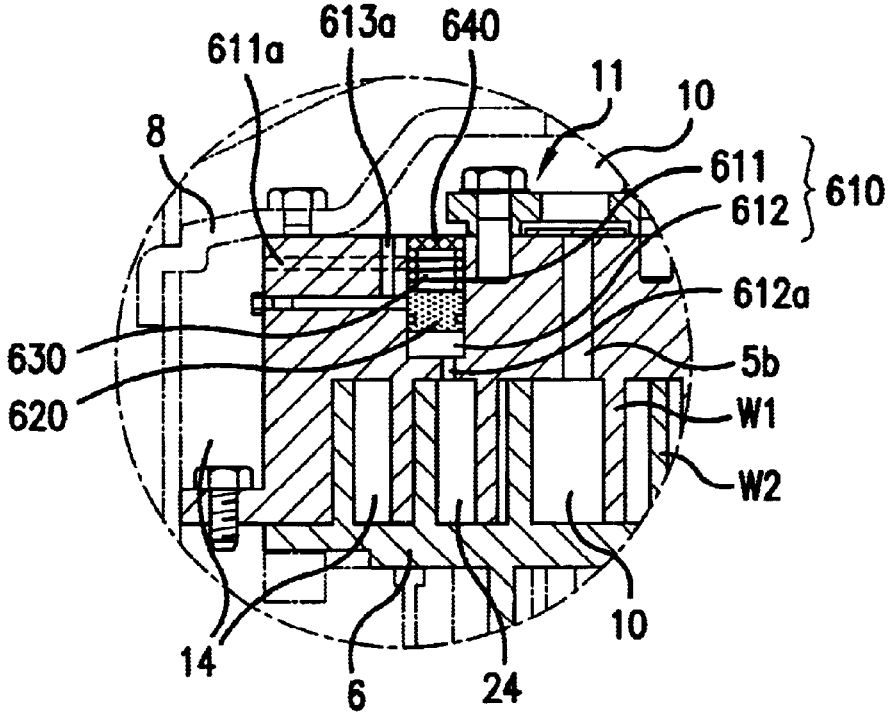
FIG. 23 is an enlarged view of the 'XXIII' portion of FIG. 21 in accordance with the sixth embodiment of the present invention.

FIG. 21 is a partial vertical-sectional view showing an apparatus for preventing vacuum compression of a scroll compressor in accordance with a sixth embodiment of the present invention, FIG. 22 is a plan view of a fixing scroll of apparatus for preventing vacuum compression of a scroll compressor in accordance with the sixth embodiment of the present invention, and FIG. 23 is an enlarged view of the 'XXIII' portion of FIG. 21 in accordance with the sixth embodiment of the present invention.

In descriptions for the sixth embodiment of the present invention, the same reference numerals are given for the same elements as those in FIGS. 15A and 15B, and descriptions therefor are omitted.

In the sixth embodiment of the present invention, a valve housing 610, there are provided a valve member 620 and an elastic member 630. As shown in FIGS. 21 to 23, the valve housing 610 is a vertical-directional valve drift space that is divided into an intermediate pressure space 611 and a discharge pressure space 612 by the valve member 620.

The suction pressure-sided gas hole 611*a* is formed at the circumferential surface of the suction pressure space 611, communicating with the low pressure changer 14. The intermediate pressure-sided gas hole 612*a* is formed at the bottom of the intermediate pressure space 612, communicating with the intermediate pressure chamber 24 of the closed chamber 3. A discharge pressure-sided gas hole 61 3*a* is formed bent by 90° upwardly of the fixing scroll 5 at the circumferential surface of the valve housing 610. The discharge pressure-sided gas hole 613*a* communicates with the high pressure chamber 10 of the closed container 3 and is opened and closed by the valve member 620.

The suction pressure-sided gas hole 611*a* is penetratingly formed to the outer circumferential surface of the fixing scroll 5, and the intermediate pressure-sided gas hole 612*a* is penetratingly formed to the intermediate pressure chamber 24 among the plurality of compressive chambers formed by the orbiting scroll 6 and the fixing scroll 5. And, the discharge pressure gas hole 613*a* is penetratingly formed to the upper surface of the fixing scroll 5

The valve member 620 is slidably inserted to the inner circumferential surface of the valve housing 610, and an O-ring (not shown) is inserted to the outer circumferential surface for sealing with the valve housing 610.

The elastic member 630 is inserted in the suction pressure space 61 of the valve housing 610, of which one end is supported by the housing stopper 640 that covers an opening of the valve housing 610 and the other end is supported by a suction pressure receiving face (no reference numeral given) of the valve member 620.

The elastic member 630 may be inserted into the suction pressure space 611 as mentioned above or may be inserted into the intermediate pressure space 612 in consideration of the intermediate pressure.

The operation of the apparatus for preventing vacuum compression of a scroll compressor in accordance with a sixth embodiment of the present invention will now be explained with reference to FIGS. 24A and 24B.

Figure 24A:
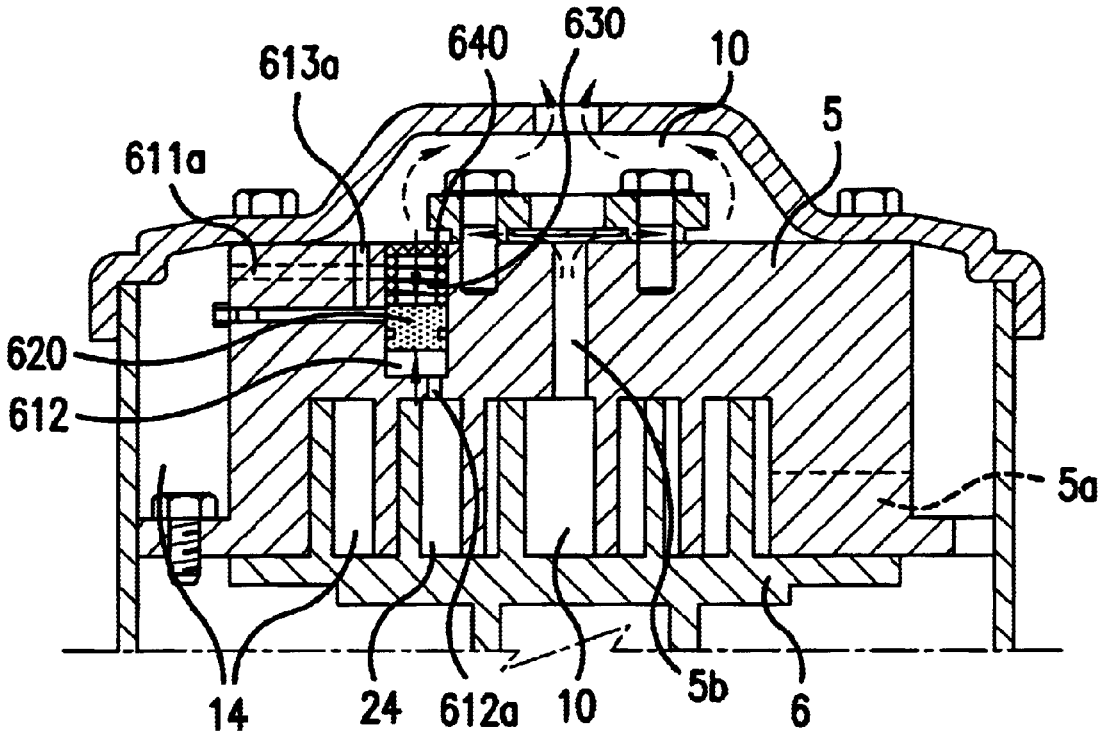
FIG. 24A is a partial vertical-sectional view showing a normal operation in the apparatus for preventing vacuum compression of a scroll compressor in accordance with the sixth embodiment of the present invention.
Figure 24B:
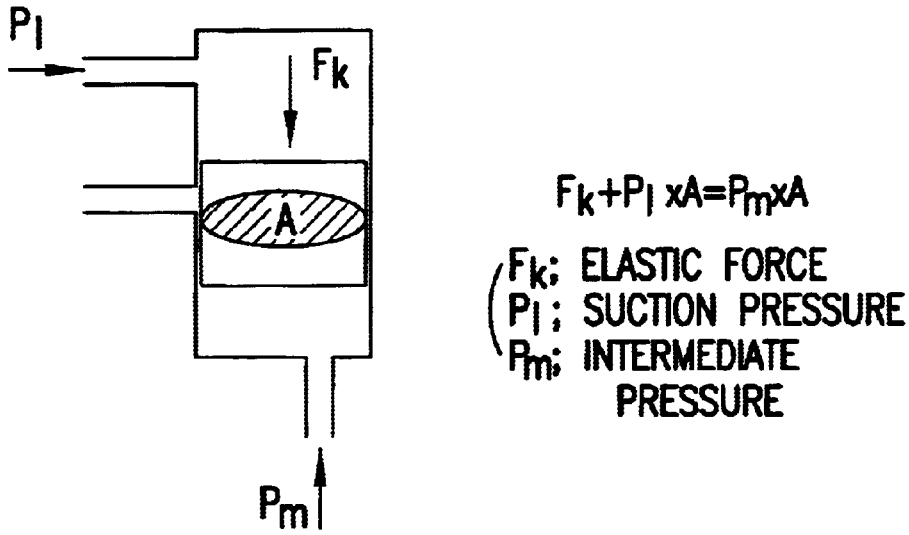
FIG. 24B is an explanatory view for showing a normal operation in the apparatus for preventing vacuum compression of a scroll compressor in accordance with the sixth embodiment of the present invention.

FIG. 24A is a partial vertical-sectional view showing a normal operation in the apparatus for preventing vacuum compression of a scroll compressor in accordance with the sixth embodiment of the present invention. and FIG. 24B is an explanatory view for showing a normal operation in the apparatus for preventing vacuum compression of a scroll compressor in accordance with the sixth embodiment of the present invention.

As shown in the drawings, during a normal operation of the compressor, the coolant gas flows into the intermediate pressure space 612 of the valve housing 610 through the intermediate pressure-sided gas hole 612*a* to push the intermediate pressure receiving face of the valve member 630, so that the pressure load (Pm×A) applied to the intermediate pressure receiving face of the valve member 620 is balanced with the elastic force (Fk) of the elastic member 630 applied to the back side and the pressure load (PI×A) of the lower pressure chamber 14 to a degree, according to which the valve member 620 blocks the discharge pressure-sided gas hole 613*a*.

In this manner, the high pressure gas of the high pressure chamber 10 flown to the suction pressure space 611 of the valve housing 610 through the discharge pressure-sided gas hole 61 3*a* is prevented from flowing back to the low pressure chamber 14 through the suction pressure-sided gas hole 611*a*.

Figure 25A:
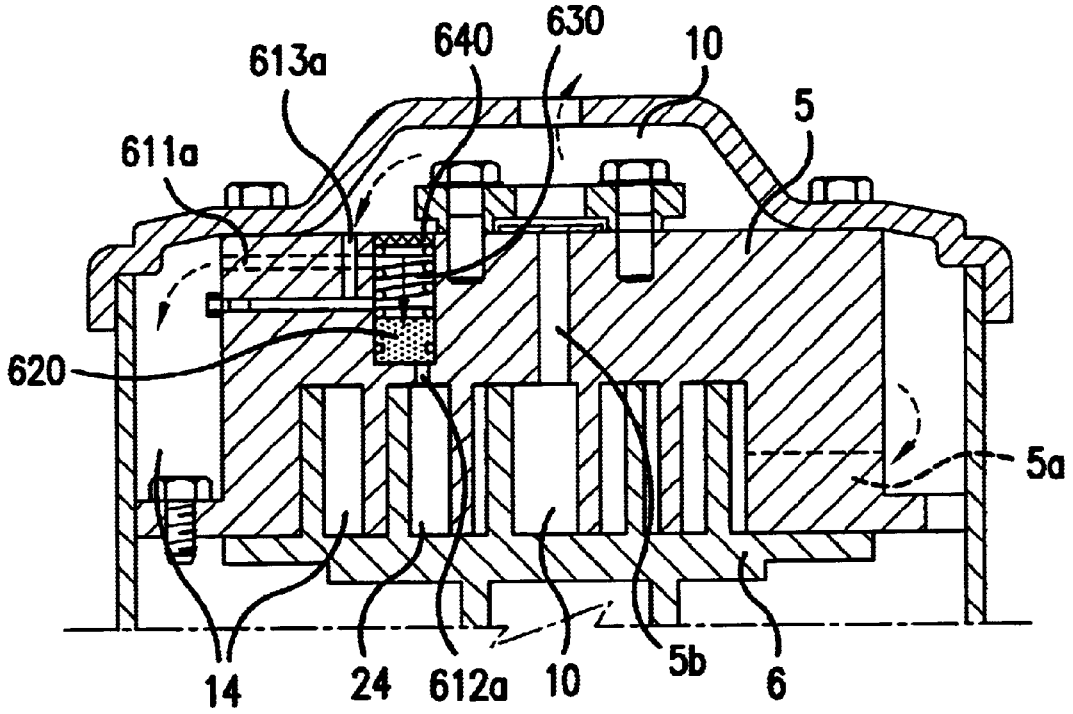
FIG. 25A is a partial vertical-sectional view showing an abnormal operation (high vacuum operation) in the apparatus for preventing vacuum compression of a scroll compressor in accordance with the sixth embodiment of the present invention.
Figure 25B:
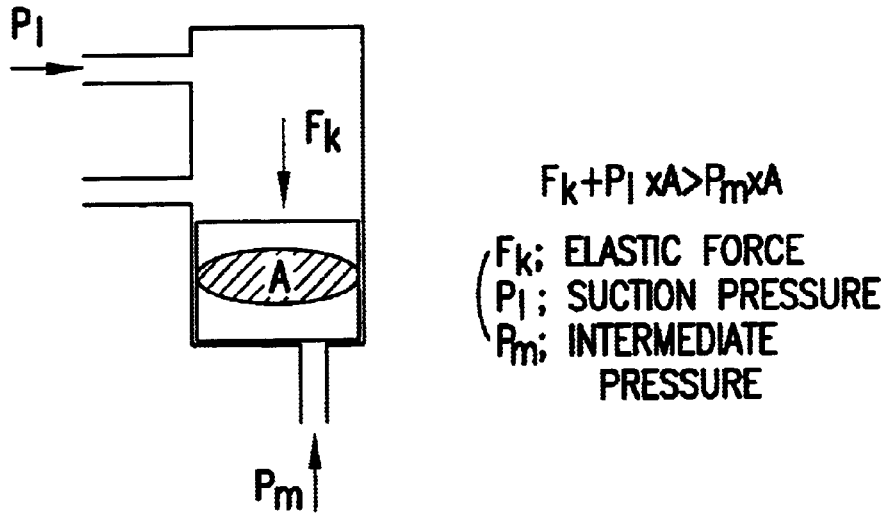
FIG. 25B is an explanatory view for showing an abnormal operation (high vacuum operation) in the apparatus for preventing vacuum compression of a scroll compressor in accordance with the sixth embodiment of the present invention.

FIG. 25A is a partial vertical-sectional view showing an abnormal operation (high vacuum operation) in the apparatus for preventing vacuum compression of a scroll compressor in accordance with the sixth embodiment of the present invention; and FIG. 25B is an explanatory view for showing an abnormal operation (high vacuum operation) in the apparatus for preventing vacuum compression of a scroll compressor in accordance with the sixth embodiment of the present invention.

As shown in the drawings, in case that the compressor is over-pressured or in case of pump down, the coolant gas of the low pressure chamber 14 and of the compressive chambers are wholly discharged to the high pressure chamber 10, rendering the intermediate pressure chamber of the compressive chamber and the intermediate pressure space 612 of the valve housing 610 to be a vacuum state, and the pressure load (Pm×A) applied to the intermediate pressure receiving face of the valve member 620 is smaller than the force adding the elastic force (Fk) of the elastic member 630 applied to the back side and the pressure load (PI×A) of the low pressure chamber 14. Resultantly, the valve member 620 is pushed to the intermediate pressure space 612, opening the discharge pressure-sided gas hole 613*a*.

And, the same time, a portion of the discharge gas of the high pressure chamber 10 flows into the suction pressure space 611 of the valve housing 610 through the discharge pressure-sided gas hole 613*a* and then flows back to the low pressure chamber 14 through the suction pressure-sided gas hole 611*a*, so that the vacuum state of the compressor is released.

Thereafter, the valve member 620 overcomes the elastic force (Fk) of the elastic member 630 and the pressure load (P1×A) by virtue of the coolant gas flown into the low pressure chamber 14 and is pushed back to the suction pressure space 611, blocking again the suction pressure-sided gas hole 611*a* and the discharge pressure-sided gas hole 613*a*.

Meanwhile, during the vacuum compression of the compressor, as long as power is not turned off, the drive motor 17 of the compressor is constantly rotated, so that the operation that the compressor is vacuum-pressured and released from the vacuum-compression state by the vacuum prevention unit 600 is repeatedly performed, according to which the valve member 620 performs a successive reciprocal movement with a certain frequency within the valve housing 610.

Figure 26A:
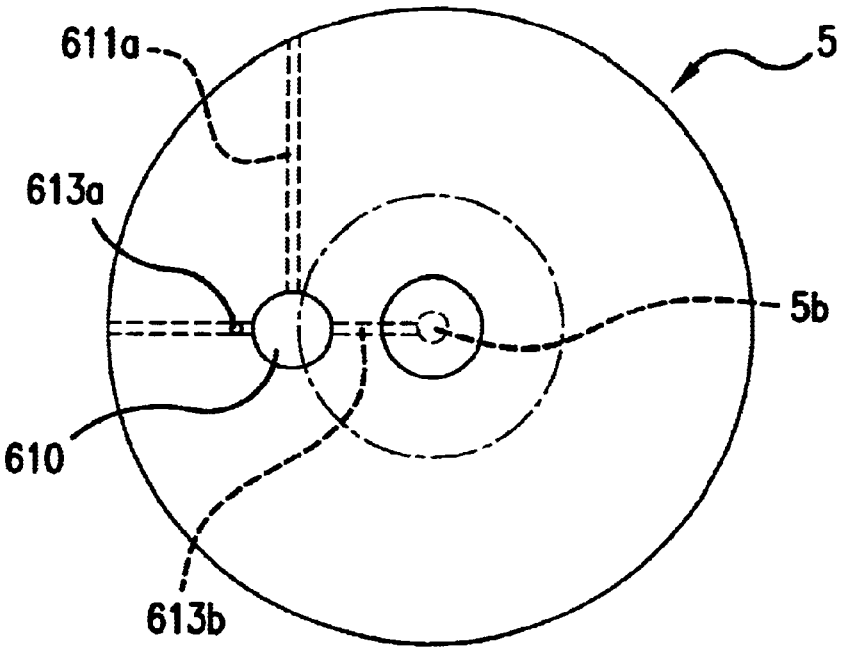
FIG. 26A is a plan view of a fixing scroll in a modification of the apparatus for preventing vacuum compression of a scroll compressor in accordance with the sixth embodiment of the present invention.
Figure 26B:
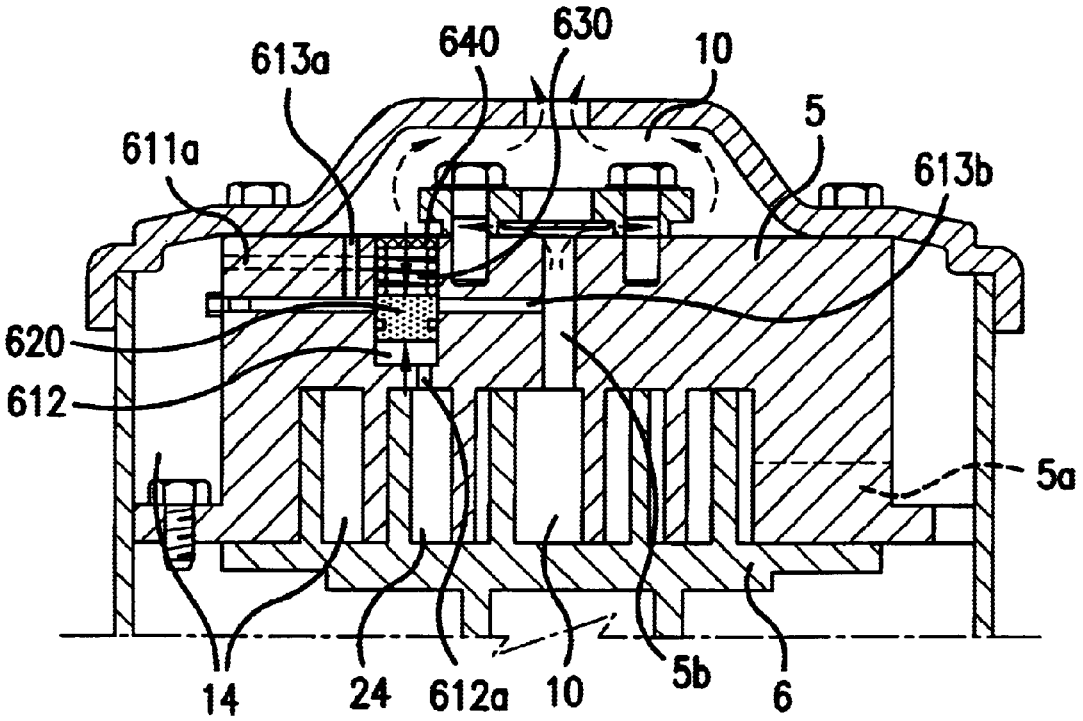
FIG. 26B is a vertical-sectional view of the fixing scroll in a modification of the apparatus for preventing vacuum compression of a scroll compressor in accordance with the sixth embodiment of the present invention.

FIG. 26A is a plan view of a fixing scroll in a modification of the apparatus for preventing vacuum compression of a scroll compressor in accordance with the sixth embodiment of the present invention, and FIG. 26B is a vertical-sectional view of the fixing scroll in a modification of the apparatus for preventing vacuum compression of a scroll compressor in accordance with the sixth embodiment of the present invention.

Unlike in the above case where the discharge pressure-sided gas hole 613*a* is formed by one at one side of the circumferential surface of the valve housing 610 upwardly of the fixing scroll 5, in this modification as shown in the drawings, a discharge pressure-sided gas hole 613*b* is additionally formed, communicating with the gas hole 5*b* of the fixing scroll 5 at the other side of the circumferential surface of the valve housing 610. In this case, since the valve member 620 receives discharge pressure from the both sides in balance, eccentricity of the valve member 620 is prevented.

As described above, the compressive chamber as well as the low pressure chamber of the closed container is prevented from a vacuum state, so that hermetic terminal is prevented from damaging possibly caused due to the vacuum state. In addition, parts is prevented from degrading caused when the compression mechanism unit is re-compressed, and thus, reliability of the compressor is improved.

INDUSTRIAL APPLICABILITY

As so far described, according to the apparatus for preventing vacuum compression of a scroll compressor of the present invention, the inside of the compressor is prevented from being an ultra vacuum state by moving the coolant of the high pressure chamber to the low pressure chamber of the inlet, so that a motor is protected from breaking down due to a short that may occur in case that the inside of the compressor becomes an ultra vacuum state, and an incident due to a leakage current can be prevented.

In addition according to the apparatus for preventing vacuum compression of a scroll compressor, since oil included in the coolant gas leaked through the back pressure line is reserved at the lower storage recess, the thrust face of the upper frame is sufficiently lubricated, so that parts can be prevented from abrading.

Moreover, according to the apparatus for preventing vacuum compression of a scroll compressor, damage of the hermetic terminal due to a vacuum compressor occurring as the low pressure chamber is vacuumized can be prevented. And, parts are prevented from degrading caused when the compression mechanism unit is re-compressed, and thus, reliability of the compressor is improved.

It will be apparent to those skilled in the art that various modifications and variations can be made in the plasma polymerization on the surface of the material of the present invention without departing from the spirit or scope of the invention. Thus, it is intended that the present invention cover modifications and variations of this invention provided they come within the scope of the appended claims and their equivalents.

What is claimed is:

1. An apparatus for preventing vacuum compression of a scroll compressor, comprising:

a suction tube and a discharge tube each combined to a closed container;

a fixed scroll having a wrap and a coolant inlet and an outlet;

a high and low pressure separating plate fixed to an upper side of the fixed scroll so that relative movement between the fixed scroll and the separating plate is prevented, the separating plate dividing the inside of the closed container into a high pressure chamber and a low pressure chamber, the separating plate having a gas discharge hole therein;

an orbiting scroll having a plurality of compressive chambers for compressing a sucked coolant by being rotatably engaged with the wrap of the fixed scroll at a lower side of the fixed scroll, and having a wrap for rendering each compressive chamber to be successively moved as the orbiting scroll is orbited; and a high vacuum preventing unit installed at the fixed scroll.

2. An apparatus for preventing vacuum compression of a scroll compressor, comprising:

a suction tube and a discharge tube each combined to a closed container;

a fixing scroll having a wrap and a coolant inlet and an outlet;

a high and low pressure separating plate installed at the upper side of the fixing scroll, dividing the inside of the closed container into a high pressure chamber and a low pressure chamber, the high and low pressure separating plate having a gas discharge hole therein;

an orbiting scroll having a plurality of compressive chambers for compressing a sucked coolant by being rotatably engaged with the wrap of the fixing scroll at a lower side of the fixing scroll, and having a wrap for rendering each compressive chamber to have different pressure to be successively moved as the orbiting scroll is orbited; and a high vacuum preventing unit installed at an inner side of a body of the fixing scroll, wherein the high vacuum preventing unit comprises:

a cylinder formed in the vertical direction inside the body of the fixing scroll; and a balance mass slidably installed inside the cylinder and having a coolant flow groove.

3. The apparatus according to claim 2, wherein an intermediate hole is formed at the lower side of the balance mass to connect the bottom of the cylinder and a by-pass hole, a high pressure chamber connection hole for communicating the cylinder and the high pressure chamber and a low pressure chamber connection hole for communicating the cylinder and the lower pressure chamber are formed at both sides of the balance mass, and a communicating unit is formed at one upper side of the balance mass to connect the upper portion of the cylinder and the low pressure chamber.

4. The apparatus according to claim 3, wherein the coolant flow groove is formed at the outer circumferential surface of the balance mass at the same height as that of the high pressure chamber connection hole and the low pressure chamber connection hole from the bottom of the cylinder, so that when the balance mass is positioned at the lower side in the cylinder, the coolant of the high pressure chamber can flow to the low pressure chamber through the coolant flow groove.

5. The apparatus according to claim 2, wherein a spring is installed at the upper portion in the cylinder so as to elastically support the cylinder downwardly.

6. An apparatus for preventing vacuum compression of a scroll compressor, comprising:

a suction tube and a discharge tube each combined to a closed container;

a fixing scroll having a wrap and a coolant inlet and an outlet;

a high and low pressure separating plate installed at the upper side of the fixing scroll, dividing the inside of the closed container into a high pressure chamber and a low pressure chamber, the high and low pressure separating plate having a gas discharge hole therein;

an orbiting scroll having a plurality of compressive chambers for compressing a sucked coolant by being rotatably engaged with the wrap of the fixing scroll at a lower side of the fixing scroll, and having a wrap for rendering each compressive chamber to have different pressure to be successively moved as the orbiting scroll is orbited; and a high vacuum preventing unit installed at an inner side of a body of the fixing scroll, wherein the high vacuum prevention unit comprises:

a valve housing formed in the lower pressure chamber and the high pressure chamber of the closed container and between the lower pressure chamber and the high pressure chamber so as to communicate with an intermediate pressure chamber while the intermediate pressure chamber is being compressed;

a valve member slidably inserted into the inner circumferential surface of the valve housing and moved according to the pressure variation of the intermediate pressure chamber depending on the operation state of the compressor to communicate or block the lower pressure chamber and the high pressure chamber to each other; and an elastic member inserted between the valve member and the valve housing to support the valve member and reinforcing the motion of the valve member.

7. The apparatus according to claim 6, wherein the valve housing is divided into a suction pressure space and an intermediate pressure space by the valve member, to thereby have a valve drift space in the horizontal direction.

8. The apparatus according to claim 7, wherein as to the valve housing, a suction pressure-sided gas hole is formed at the suction pressure space to communicate with the low pressure chamber of the closed container, an intermediate pressure-sided gas hole is formed at the intermediate pressure space to communicate with the intermediate pressure chamber of the closed container, and a discharge pressure-sided gas hole is formed at the circumferential surface to be opened and closed by the valve member to communicate with the high pressure chamber of the closed container.

9. The apparatus according to claim 8, wherein a valve stopper unit is provided at the intermediate pressure space of the valve housing so as to block the intermediate pressure-sided gas hole.

10. The apparatus according to claim 9, wherein the valve stopper unit is a hooking member fixedly inserted into the inner circumferential surface of the valve housing.

11. The apparatus according to claim 9, wherein the valve stopper unit is a protrusion formed at the inner circumferential surface of the valve housing.

12. The apparatus according to claim 8, wherein another suction pressure-sided gas hole is additionally provided at the circumferential surface of the valve housing to be opened by the valve member to communicate with the low pressure chamber, besides the discharge pressure-sided gas hole.

13. The apparatus according to claim 12, wherein one of the suction pressure-sided gas hole is penetratingly formed to the outer circumferential surface of the fixing scroll while the other of the suction pressure-sided gas hole is penetratingly formed to the low pressure chamber among the plurality of compressive chambers formed by the orbiting scroll and the fixing scroll.

14. The apparatus according to claim 8, wherein the intermediate pressure-sided gas hole is penetratingly formed to the intermediate pressure chamber among the plurality of compressive chambers formed by the orbiting scroll and the fixing scroll.

15. The apparatus according to claim 6, wherein the elastic member is inserted in the suction pressure space of the valve housing.

16. The apparatus according to claim 6, wherein the valve housing is divided into the intermediate pressure space and the discharge pressure space by the valve member, so as to have a valve drift space in the vertical direction. together with the suction pressure-sided gas hole by the valve member so as to communicate with the high pressure chamber of the closed container.

17. The apparatus according to claim 16, wherein, as to the valve housing, a suction pressure-sided gas hole is formed at the circumferential surface to be opened and closed by the valve member to communicate with the low pressure chamber, an intermediate pressure-sided gas hole is formed at the intermediate pressure space to communicate with the intermediate pressure chamber of the closed container, and a discharge pressure-sided gas hole is formed at the discharge pressure space to be opened and closed together with the suction pressure-sided gas hole by the valve member so as to communicate with the high pressure chamber of the closed container.

18. The apparatus according to claim 17, wherein the discharge pressure-sided gas hole is formed smaller than the inner diameter of the valve housing so that the cross section of the discharge pressure receiving face of the valve member is smaller than the cross-section of the suction pressure receiving face.

19. The apparatus according to claim 18, wherein a volume protrusion is formed at one side of the valve member corresponding to the inner side end of the discharge pressure-sided gas hole so as to be slidably inserted into the discharge pressure-sided gas hole.

20. The apparatus according to claim 16, wherein the elastic member is inserted in the intermediate pressure space of the valve housing.

21. The apparatus according to claim 6, wherein the valve housing is divided into a suction pressure space and an intermediate pressure space by the valve member to have a valve drift space in the vertical direction in which a suction pressure-sided gas hole is formed at the suction pressure space to be opened and closed by the valve member to communicate with the low pressure chamber, an intermediate pressure-sided gas hole is formed at the intermediate pressure space to communicate with the intermediate pressure chamber, and at least one discharge pressure-sided gas hole is formed at the circumferential surface to be opened and closed by the valve member along with the suction pressure-sided gas hole to communicate with the high pressure chamber.

22. The apparatus according to claim 21, wherein the discharge pressure-sided gas holes are formed at equal intervals at the circumference of the same height.

23. The apparatus according to claim 21, wherein the elastic member is inserted in the suction pressure space of the valve housing.

24. The apparatus according to claim 23, wherein the elastic member is additionally inserted in the intermediate pressure space of the valve housing.

25. An apparatus for preventing vacuum generation of a scroll compressor, comprising:

a fixed scroll having a discharge hole formed therein;

a valve stopper combined to an upper portion of the discharge hole, the valve stopper including a guide face therein;

a check valve installed in the scroll compressor and movable upwardly and downwardly along the guide face of the valve stopper to control flowing of coolant gas of high pressure and high temperature, to open and close the discharge hole of the fixed scroll; and a mutually communicating by-pass hole located in the guide face for by-passing high pressure coolant gas to a low pressure side at a time when the check valve closes the discharge hole of the fixed scroll, the by-pass hole being closable by a sidewall of the check valve when the check valve is spaced from the discharge hole of the fixed scroll.

26. The apparatus according to claim 25, wherein at least one by-pass hole is formed both in the inner side of the valve stopper and in the fixed scroll.

27. The apparatus according to claim 26, wherein the bypass hole existing at the inner side of the valve stopper is formed at a position where it can be opened when the check valve is lowered down and nears the fixed scroll.

28. The apparatus according to claim 26, wherein the bypass hole formed at the inner side of the valve stopper and the by-pass hole formed at the fixed scroll are different sizes.

29. An apparatus for preventing vacuum generation of a scroll compressor, comprising:

a fixing scroll having a discharge hole formed therein;

a valve stopper combined to an upper portion of the discharge hole, the valve stopper including a guide face therein;

a check valve installed in the scroll compressor and movable upwardly and downwardly along the guide face of the valve stopper to control flowing of coolant gas of high pressure and high temperature compressed in the compressive chamber, to open and close the discharge hole of the fixing scroll; and a mutually communicating by-pass hole for by-passing high pressure coolant gas to a low pressure side at a time when the check valve closes the discharge hole of the fixing scroll, wherein a guide groove is formed at the upper portion of the discharge hole of the fixing scroll on which the check valve is mounted.

* * * * *